US008279219B2

(12) United States Patent
Ghazali

(10) Patent No.: US 8,279,219 B2
(45) Date of Patent: Oct. 2, 2012

(54) METHOD OF SUBDIVIDING A PLOT OF LAND FOR HOUSING AND A HOUSING SUBDIVISION SO FORMED

(76) Inventor: Mazlin B. Ghazali, Selangor (MY)

( * ) Notice: Subject to any disclaimer, the term of this patent is extended or adjusted under 35 U.S.C. 154(b) by 1436 days.

(21) Appl. No.: 10/586,169

(22) PCT Filed: Jan. 13, 2005

(86) PCT No.: PCT/AU2005/000030

§ 371 (c)(1),
(2), (4) Date: Oct. 23, 2006

(87) PCT Pub. No.: WO2005/069174

PCT Pub. Date: Jul. 28, 2005

(65) Prior Publication Data

US 2007/0219759 A1 Sep. 20, 2007

(30) Foreign Application Priority Data

Jan. 16, 2004 (AU) ..... 2004900191

(51) Int. Cl.
*G06T 15/30* (2011.01)

(52) U.S. Cl. ..... 345/423; 52/169.2

(58) Field of Classification Search ..... 345/423; 52/169.2

See application file for complete search history.

(56) References Cited

U.S. PATENT DOCUMENTS 3,732,649 A 5/1973 Mehran
4,679,363 A * 7/1987 Adams ..... 52/169.3
4,852,313 A 8/1989 Jones
6,688,052 B1 * 2/2004 Flanders ..... 52/169.3
2002/0108346 A1 * 8/2002 Showen ..... 52/741.1

FOREIGN PATENT DOCUMENTS

NL 1005702 12/1998

OTHER PUBLICATIONS

Anon.; *James Finck: New Redding Planner* . . . ; The Latest Developments, vol. II, Issue 1; pp. 1,3,5; Redding, CA Development Services. (See especially p. 5, Building Permit Applications, last dot point.) www.ci.redding.ca.us/devserv/latestdev.html.

(Continued)

*Primary Examiner* — Maurice L McDowell, Jr.
(74) *Attorney, Agent, or Firm* — James Creighton Wray

(57) ABSTRACT

A method for sub-division of a plot of land comprises the steps of forming, on a polygonal basic tile shape, a layout of a basic precinct unit comprising an array of occupiable spaces of predetermined shape, at least one access way communicating with each occupiable space and tessellating the polygonal basic tile shapes over an area to be sub-divided whereby respective said at least one access way of each basic precinct unit connects with an access way of an adjacent basic precinct unit to form a network of connecting access ways, said basic precinct unit, together with an adjacent basic precinct unit forming an inter-tile unit of predetermined shape from two or more adjacent occupiable spaces, said inter-tile unit linking adjacent basic precinct units. The tessellation is formed computationally and the computation may include dimensional, boundary and topographical contour data of a plot of land to be subdivided.

28 Claims, 22 Drawing Sheets

OTHER PUBLICATIONS

Ron Gaches; *Kansas Society of Professional Engineers Legislative Report*; Issue No. 5, Feb. 25, 2002 www.kansasengineer.org/govaffairs/2002No5.pdf.

Anon.; *Planning and Zoning Committee of the MidCoast Community Council*, Agenda for Wednesday May 21, 2003; mcc.sanmateo.org/PandZ/Agendas/PandZ_05_21_03.pdf.

Derwent Abstract Accession No. 98-131238, De 19631969 A1 (Knepper) Feb. 19, 1998.

Derwent Abstract Accession No. 96-225517, JP 08086099 A (Sekisui House KK) Apr. 2, 1996.

Derwent Abstract Accession No. 02-651749, JP 2002236826 A (Sekisui House KK) Aug. 23, 2002.

Derwent Abstract Accession No. 02-651673; TO1 JP 2002236716 A (Misawa Homes Co Ltd) Aug. 23, 2002.

Derwent Abstract Accession No. 00-278155, TO1 JP 2000076318 A (Misawa Homes Co Ltd) Mar. 14, 2000.

* cited by examiner

TYPE A

TYPE B

TYPE C

TYPE D

TYPE E

METHOD OF SUBDIVIDING A PLOT OF LAND FOR HOUSING AND A HOUSING SUBDIVISION SO FORMED

This application claims the benefit of Australian Application No. 2004900191 filed Jan. 16, 20004 and PCT/AU2005/000030 filed Jan. 13, 2005, which are hereby incorporated by reference in their entirety.

FIELD OF THE INVENTION

This invention is concerned with a method for sub-division of a plot of land and a sub-division so formed.

The invention is generally concerned with domestic dwellings in a housing development which comprises repetitive forms of housing where each housing unit sits on its own plot of land.

The invention is concerned particularly, although not exclusively, with a method of planning and design that generates housing layouts, types of housing units, the form and distribution of the spaces between the housing units, and the characteristics of the roads that serve each unit.

BACKGROUND OF THE INVENTION

Individual ownership of discreet areas of land has been a fundamental desire of many human beings expressing their nature as both an acquisitive and social animal.

The simplest form of ownership is a land title granted by the state that designates the boundaries of the land, the owner and the entitlement that the owner has as owner.

As world population numbers and densities increase, there is a continuous demand for larger numbers of land titles to be issued. The process of dividing a large area of land into smaller areas is generally referred to as sub-division.

In order to make use of any land area either as a single individual, as a family, or as a social or enterprise group, it is necessary to gain access to it in some way, and to gain access to essential services that make habitation of the land environmentally, commercially, and humanly sustainable.

This access is normally achieved by incorporating public road, and service distribution systems within the land subdivisions, or legalizing some entitlement which allows shared access with another land owner or owners.

The area occupied by the road access system is essentially shared land owned by a group, normally the state who also control the limits and rules associated with the granting of new land titles.

The whole process is often referred to as town planning. The reasons for a landowner to allow or encourage his land to be sub-divided are almost always associated with profit. A large plot of land is normally less valuable than that same plot divided into smaller saleable sections provided there is access to each individual parcel or lot.

The basic technique for sub-dividing land starts with the arrangement of the access system. Often the road system is already in place and the sub-division is simply a process cutting the land into narrower plots that continue to share the same (public) road. However, sometimes it is necessary to provide new roads entering the land to be sub-divided. These roads are usually arranged according to some preconceived notion of how the land will then be sub-divided, and they determine to a great extent the appearance of the final sub-division.

It is the normal practice when creating a sub-division to create these roads first in a grid or other pattern, and to then divide the land so that each block has access to them. An alternate process involves the creation of groups of land with a perimeter of access way attached to it that can be arranged in a pattern on the site.

The land occupied by roads is essentially not "saleable", and so it is important to reduce the land occupied by such roads.

There are many ways of doing this including the adoption of very narrow long blocks, the use of narrow roads, management of the hierarchy of access ways to allow them to be narrower, shared access, or the adoption of new forms of land title such as group or strata title.

All of these operate on an outside-in approach, where access ways are created first with the sub-division working away from them or the sub-division is created within a perimeter of access or service corridors. This approach tends to cause the access ways to dominate the design and particularly in dense sub-divisions when groups of buildings are attached to each other, cause the area occupied by roads to be large when compared to the land they give access to. This approach also tends to force the access ways to define the major social aspects of the development or the way in which the occupiers of the land will react with each other once the land is occupied. This forcing is at its most obvious when the lots are small, and is typical of very dense landed property developments such as row or terrace housing.

This forcing of social outcome is generally considered to be a negative by many sociologists and town planners. Most sociologists believe that it is important for human beings to have distinct private, or their own family space, semi-private, or space in which they mix with people they are familiar with and public, or space in which they mix with strangers. It is important that private space is buffered by a layer of semi-private space. Many criminologists also agree that this sort of arrangement reduces crime rates and improves the security of residential communities.

Previous attempts to optimize land utilization in a sub-division project whilst retaining some sense of aesthetics generally have related to schemes for land sub-division, with or without schemes for arrangement of building structures on sub-divided plots. Other attempts at optimization of land usage have related to specific structural configurations of buildings to optimize occupant amenity in a high density environment.

U.S. Pat. No. 3,623,296 describes a multistorey structure to accommodate trailer homes and the like in a more efficient and aesthetically pleasing manner.

A physical arrangement of pre-constructed building modules described in U.S. Pat. No. 3,629,983 is said to achieve efficiency of construction and economy of land use. Similarly, U.S. Pat. No. 3,678,639 describes a mobile home arrangement which enables the configuration of two or more mobile homes to give the appearance of a single conventional dwelling.

U.S. Pat. No. 3,720,023 describes a complex array of patio houses arranged in such a way as to reduce building costs whilst maximizing land utilization.

Other techniques for maximizing land utilization in a residential sub-division utilize common walls between adjacent building structures or rigidly proscribed layouts of building structures, land plot shapes and access roadways. Examples of sub-divisions utilizing common walls between adjacent structures are disclosed in U.S. Pat. Nos. 3,732,649, 3,874,137, 3,996,709, 4,325,205 and 4,920,711.

U.S. Pat. Nos. 4,575,977, 4,679,363, 4,852,213, 5,671,570, 5,761,857 and 6,470,633 each deal with residential land sub-division on a "micro" scale but the inflexibility of the "micro" sub-divisional regions or units, when applied on a "macro" scale do not achieve the combination of flexible land use optimization and general amenity as provided with the present invention.

Terrace or row house sub-division represents the densest form of landed property development currently available. However, in a row or terrace house development there is almost no semi-private space. Houses face directly onto a major street with only a small exposed yard separating them from it. The streets are through streets generally carrying traffic from a large radius around any individuals home. They are often used as alternative access to commuters passing through the area.

In order to overcome these undesirable outcomes, new forms of title have been created for residential, and to a limited extent, commercial developments.

Often called "group title" or "cluster housing" these allow for the development of larger pieces of land on which a cluster of dwellings or other buildings are built, normally attached to each other. The ownership of the land is shared while often the buildings are owned by individual titles. The social outcome is considered by many to be better, while the ownership or tenure is no doubt less secure, and potentially less valuable.

Generally speaking, housing units that sit on their own plots of land are called landed property. Such housing units may be detached, as in the bungalow, or linked. Common types of linked housing units are the semi-detached house, the terrace house and the cluster house, which comprises four or more housing units in one block.

In a conventional repetitive housing development, housing units are repeated along a road, resulting in rows or blocks of houses called row housing. In many countries, government authorities such as Local Governments, State and Federal Town and Regional Planning Departments, the Construction Industry Development Board and the Fire and Rescue Departments have strict guidelines on the design of repetitive housing units on landed property, particularly as they relate to row housing. In general, the most efficient way to put as many housing units on each acre of land is by arranging row housing orthogonally in a regular grid plan.

Given land boundaries that form irregular shapes and geographical features that form naturally, the rigid orthogonal grid arrangement may not be suitable. Moreover, in order to achieve more interesting designs, the orthogonal grid may be adjusted by curving or bending the roads and rows of houses to follow the natural contours and boundaries. Alternatively, the orthogonal grid may be replaced by a radial grid to achieve more interesting forms or the dimensions of the basic housing unit or row of units may be altered to better fit the land. Often, multiple grids are employed within a housing site and consequently various row housing layout patterns result from prior art housing sub-division methods.

However, as a general rule, it is safe to conclude that the more irregular, the more organic the plan of a row housing layout, the less efficient becomes the layout in terms of land usage.

Where cost and land-use efficiency is a priority, the social features of row housing suffer. In row housing estates, the road is the public space that fronts each house unit. That road is designed for the car rather than the pedestrian rendering it less suitable for social interaction, and unsuitable as a play area for smaller children. That road is also a public domain, accessible not only to the residents and their guests, but also to uninvited strangers and potential criminals. The longer and the more interconnected the roads, inviting faster traffic speeds and potential criminals, the more unsafe is the public space just outside the house. There may be public amenities like playgrounds and green spaces in a housing estate, but these may be streets away, unsuitable for smaller children to go to their own, and being public areas, subject to vandalism and neglect.

Poor housing forms can contribute to social dysfunction. Social and human factors play the major role in creating good neighbourhoods but housing design too can play a role. Studies of prior art housing communities have focussed on three important issues:

i) The influence of the built environment on the level of social interaction.

ii) The design features of housing that can reduce the incidence of crime.

iii) The role and effect of the environment outside the home on the preschool child.

Jan Gehl, "Life Between Buildings" (1971), presented empirical evidence that correlated housing design features which inhibited or promoted social interaction. Oscar Newman, an architect, modified the buildings of public housing in New York, housing that could be described as crime-ridden slums. He found that certain design features successfully reduced crime. His design strategy described in his book "Defensible Space" (1972) was to modify the public spaces around the houses that are "no man's land", such that the residents are given ownership of these "shared" spaces. Charles Mercer, "Living in Cities" (1975), citing the work of Lee Rainwater (1966) and John & Elizabeth Newson (1968) posited that play is an important arena for learning for the child; that growing up can be seen as a process, where the child becomes more and more independent of the parent, exploring first the spaces around the mother, other rooms in the house, the front yard, and so on. In this work, he considered that the opportunity for exploring new environment is best presented in small discreet steps so that the child can explore them at his own pace.

A problem with a typical urban or suburban situation is that the process of exploring new territory independent of the parent stops at the front gate. Beyond that is not considered safe. When a child is finally old enough to go out unaccompanied by an adult, he or she is disadvantaged compared to a child that could explore bit by bit the neighbourhood around the home. This suggests that the space outside the home should be made conducive to the growing up process. It should be safe for smaller children with ample play and civic amenities. Play areas with parks or sports fields some minutes away from the home do not serve this function.

It is possible when designing row housing to design a road network in such a way as to create more exclusive, semi-private, pedestrian friendly zones by creating looping roads, cul-de-sacs and placing green spaces in front of each house but this will reduce the land-use efficiency, increase the cost of the development and render it either unaffordable to the public, or commercially unfeasible. Similarly, where cost is a priority, the aesthetic features of the row housing suffer because land-use efficiency requires:

rectangular plots of land narrow frontages, the narrower the better regular facade lines, the straighter the better.

Generally speaking, the more irregular the shape of the housing unit, the wider its frontage, the more articulated the facade, the more expensive becomes the development cost.

In the particular case of the terrace house, which is the most land-efficient, and hence the most common type of row housing, the long block of terrace houses does not fit well on naturally sloping or undulating sites. It is cheaper to excavate hills, and fill valleys and streams to provide relatively flat platforms for the long blocks. Extensive earthworks is a cheaper alternative than the extra construction cost incurred when level changes are introduced within the block. Environmentally, this is a particularly grave disadvantage of row terrace housing as the natural terrain and environment of hills and valleys is flattened and natural steams replaced with concrete drains.

It is an aim of the invention to overcome or alleviate at least some of the disadvantages of prior art methods for sub-division of land.

It would be desirable to provide a novel design method of planning repetitive housing resulting in novel types of housing units and layout that can overcome the social, aesthetic and environmental shortcomings of row housing but which meets the test of commercial viability, in keeping down the cost of land, infrastructure and earthworks and render the new types of houses affordable. In particular, it would be desirable to find a viable alternative to the terrace house as the most cost efficient building type for landed property development.

It would be desirable also to improve the pattern of roads and public spaces that serve housing units and to create better neighbourhoods which increase the value of a housing development. At the same time it would be most desirable to achieve better land use efficiency and to reduce infrastructure costs.

SUMMARY OF THE INVENTION

According to one aspect of the invention there is provided a method for sub-division of a plot of land, said method comprising the steps of:

forming on a polygonal basic tile shape a layout of a basic precinct comprising an array of occupiable spaces of predetermined shape, at least one access way communicating with each occupiable space; and, tessellating said polygonal basic tile shapes over an area to be sub-divided whereby respective said at least one access way of each basic precinct unit connects with an access way of an adjacent basic precinct unit to form a network of connecting access ways, said basic precinct unit, together with an adjacent basic precinct unit forming an inter-tile unit of predetermined shape from two or more adjacent occupiable spaces, said inter-tile unit linking adjacent basic precinct units.

If required, said polygonal basic tile shape may comprise a plurality of polygonal sub-tiles of predetermined shape.

Suitably, each said polygonal sub-tile may comprise a layout including at least portion of an occupiable space and at least portion of an access way.

Preferably, each said polygonal sub-tile further comprises at least portion of a common space.

The sub-tile may comprise part or all of one or more housing lots.

If required, each said sub-tile shape may be identical.

Alternatively, said sub-tiles may comprise an array of discrete occupiable spaces and at least one access way.

Said sub-tiles may have the same or differing shapes.

If required, said basic tile shapes may be tessellated to form a super-tile shape containing provision for public amenities.

Preferably, said super-tile may be tessellated with super-tiles of the same or differing shapes.

According to another aspect of the invention there is provided a land sub-division whenever effected according to the foregoing method(s).

According to a further aspect of the invention there is provided a method for sub-division of a plot of land, said method characterized by the steps of:

inputting into a processing device dimensional, boundary and topographical contour data of a plot of land to be sub-divided;

selecting from a data storage means associated with said processing device at least one polygonal basic tile shape;

forming on said polygonal basic tile shape a layout of a basic precinct unit comprising an array of occupiable spaces selected from a stored range of predetermined shapes and at least one access way communicating with each occupiable space;

computing a tessellation of said polygonal basic tile shapes over a computer surface of said plot of land within a predetermined dimensional ratio whereby respective said at least one access way of each basic precinct unit connects with an access way of an adjacent basic precinct unit to form a network of connecting access ways over said computer surface of said plot of land to be sub-divided, each said basic precinct unit, together with an adjacent basic precinct unit, forming an inter-tile unit of predetermined shape from two or more adjacent occupiable spaces, said inter-tile unit linking communal spaces of adjacent basic precinct units; and, outputting to a display device a computer sub-divisional plan for said plot of land.

According to a still further aspect of the invention there is provided a computer software programme for sub-dividing land according to the aforesaid method, said software programme being adapted to form tile units and sub-units according to predetermined ratios of occupiable space and access ways comprised in a basic precinct unit, said software permitting tessellation of said tile units over a predetermined land area whereby selected tile units are manipulable to allow interconnection of precinct unit access ways to form a network of interconnecting access ways.

If required, said software may form tessellatable super-tile shapes comprising a plurality of tessellated tile units.

Preferably, said software is adapted to permit a best fit adaptation of tessellatable shapes comprising said precinct units to a predetermined land boundary and/or land contour variations.

As used herein, the expression "occupiable space" means any space to which a right of occupancy pertains, either by way of ownership title, lease agreement, rental agreement, or any other agreement by which an occupier is legally entitled to occupy, having rights of access or entry to and/or to use the occupiable space in a manner approved by or with the consent of the owner thereof.

While the present invention is illustrated by reference to sub-division of a plot of and for housing or residential purposes, it should be understood that the invention is equally applicable to the sub-division of land space for commercial developments including factories, shops and offices. Accordingly, expressions such as "precinct", "access way", "common space" and "communal space" each will have a meaning which may differ according to the context in which those expressions are used. By way of example, but not by way of limitation, "common space" and/or "communal space" may in some contexts mean publicly available space but in the context, say, of a gated or closed community, "common space" and/or "communal space" may refer to spaces accessible only by members of that community or otherwise only with the consent or permission of one or more members of that community. Similarly, "access way" in certain contexts could include "common space" or "communal space".

BRIEF DESCRIPTION OF THE DRAWINGS

In order that the various aspects of the invention may be more readily understood and put into practical effect, reference is made to preferred embodiments and comparative prior art methods illustrated in the accompanying drawings wherein.

For the sake of simplicity, like reference numerals are employed in the drawings for like features where convenient.

Throughout this specification and claims which follow, unless the context requires otherwise, the word "comprise", and variations such as "comprises" or "comprising", will be understood to imply the inclusion of a stated integer or group of integers or steps but not the exclusion of any other integer or group of integers.

DETAILED DESCRIPTION OF THE DRAWINGS

The expression "tessellate" originated in the paving of surfaces with mosaic tiles to form a fully covered surface with a pattern without gaps and with no overlapping. When tiles are fitted together to cover a surface, a tessellation occurs. The tiles can be a square or any polygon or any pattern so long as certain mathematical rules are satisfied.

Existing planning methods where individual housing units are repeated to form blocks, and blocks repeated to form rows of blocks could be described as tessellations of a rectangular pattern, however tessellating rectangles is but a small subset of all possible tessellations.

Figure 1:
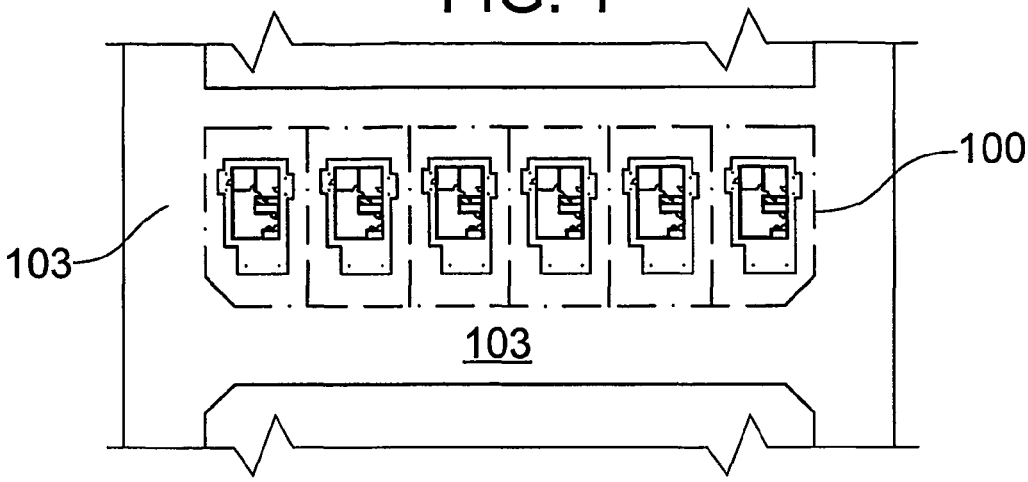
FIGS. 1 to 3 illustrate respectively typical prior art rectangular patterns of bungalows, semi-detached row houses and quadriplex cluster houses.
Figure 2:
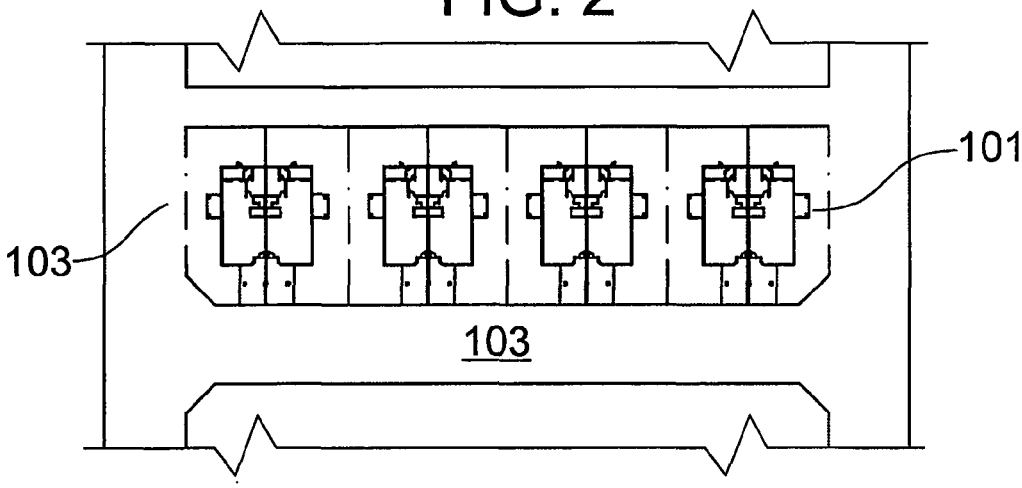
Figure 3:
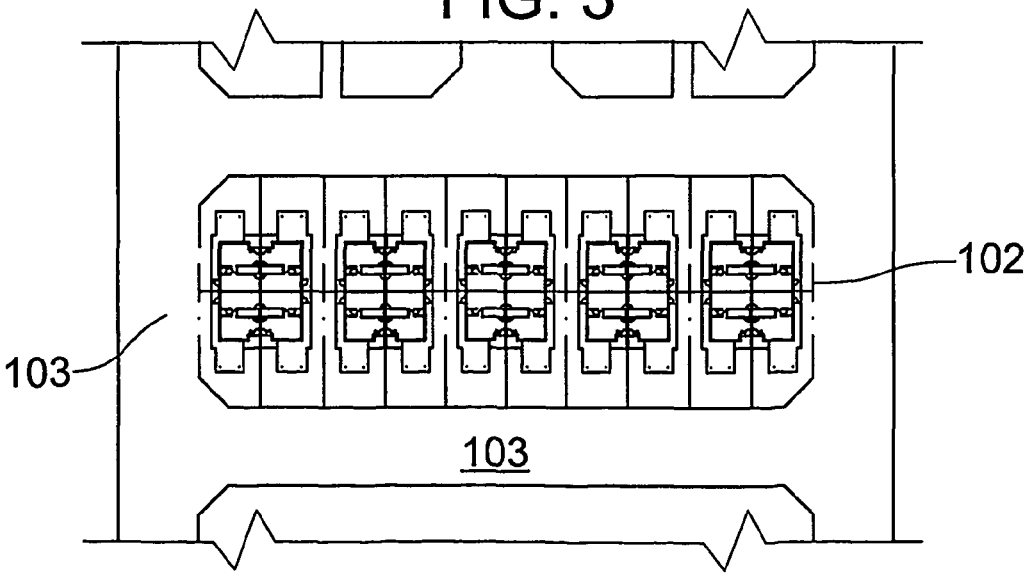

FIGS. 1 to 3 illustrate respectively typical prior art rectangular pattern arrays of bungalows, semi-detached row houses and quadriplex cluster houses. 100, 101 and 102 respectively, each array being bounded by roadways 103.

Figure 4:
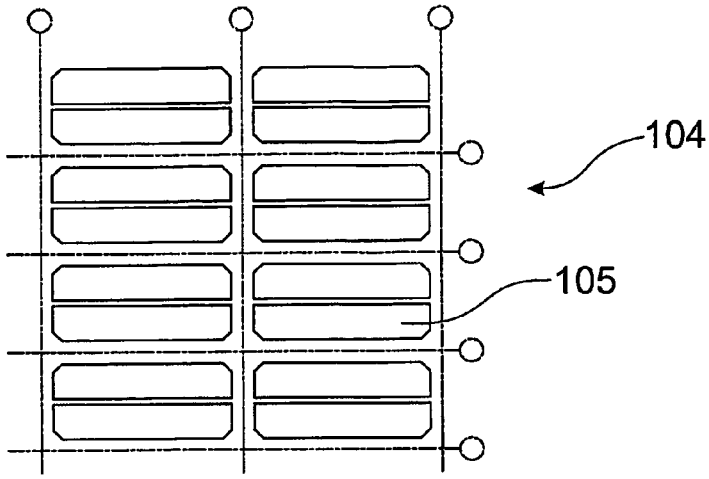
FIG. 4 illustrates a prior art rigid rectangular grid array.

FIG. 4 illustrates a typical prior art rigid rectangular grid array 104 of terrace housing blocks 105.

Figure 5:
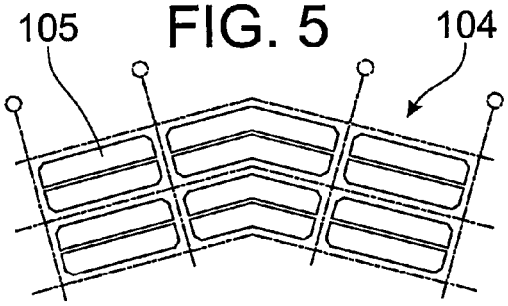
FIGS. 5 to 7 show prior art grid deviations.
Figure 6:
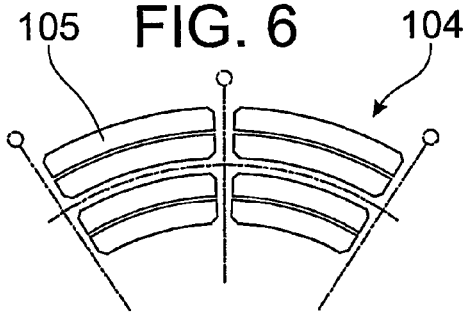
Figure 7:
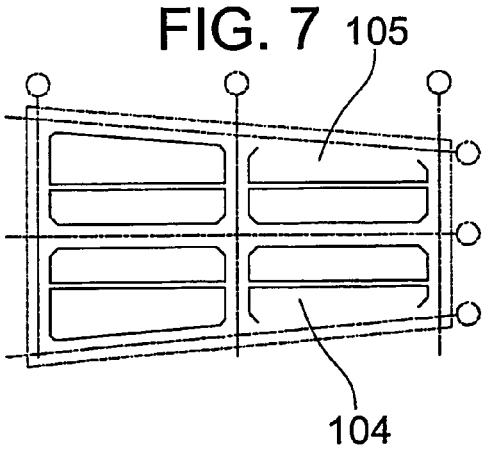

FIGS. 5, 6 and 7 illustrate typical prior art deviations from a rigid rectangular grid array.

Figure 8:
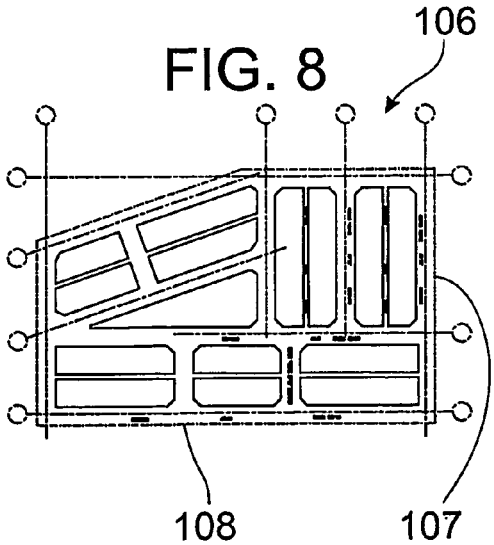
FIG. 8 shows a multiplicity of rectangular grid arrays.

FIG. 8 illustrates one form of prior art housing sub-division 106 using multiple rectangular type grids 107 with a housing site 108.

Tessellations of just a few basic tile designs utilizing rectangular and/or other polygonal shapes can result in complex and beautiful decorative patterns for paving and other decorated surfaces. Although such patterns may appear to be a combination of many interlocking polygonal shapes, these patterns may be achieved with plain or decorated tile elements which fit together to form a tile member which in turn fits together with other tile members to form what otherwise appears to be a complex pattern of geometric shapes.

Figure 9:
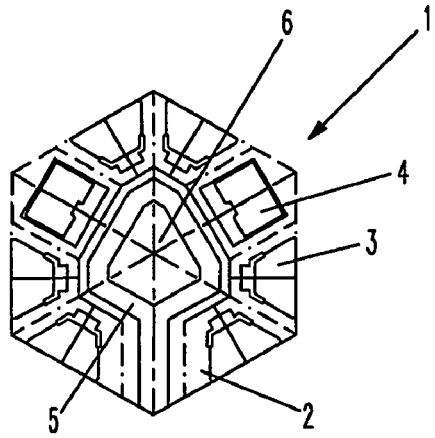
FIG. 9 shows a basic neighbourhood unit according to one aspect of the invention.

FIG. 9 shows a hexagonal basic neighbourhood unit 1 comprising a plurality of sub-units 2 which accommodate repetitive housing units 3,4 of differing types clustered around a connecting service road 5 forming a cul-de-sac encircling a communal garden area 6.

Figure 10:
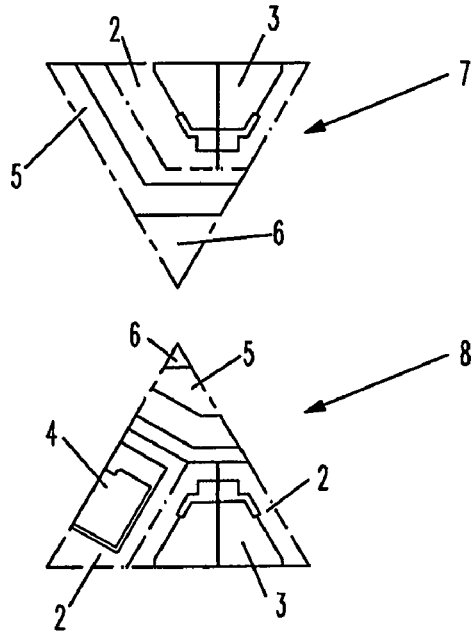
FIG. 10 shows sub-units comprised in the basic unit of FIG. 9.

The hexagonal shape of basic unit 1 is in fact comprised of tessellated triangular sub-units or elements 7,8, each representing a pair of basic layout patterns as shown in FIG. 10.

Figure 11:
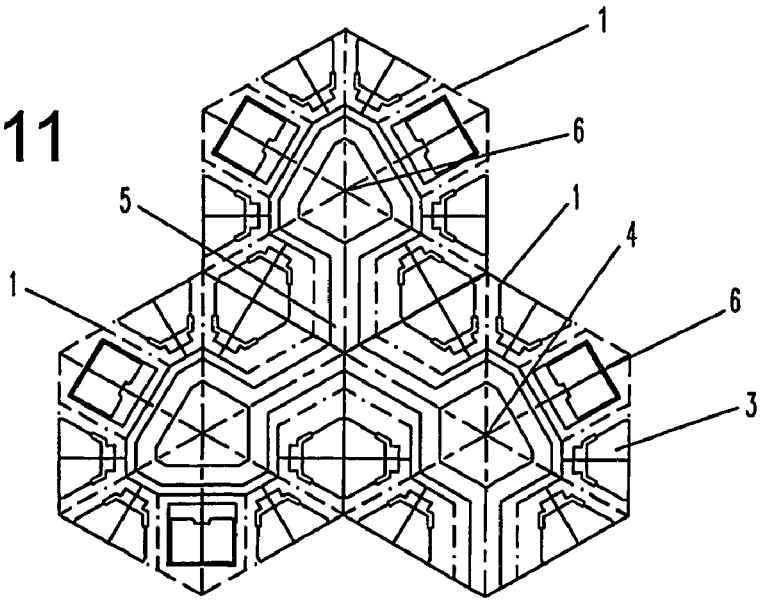
FIG. 11 shows a tessellation of basic units of FIG. 9.

The polygon that contains this basic neighbourhood arrangement is then tessellated as shown in FIG. 11. The resulting pattern produces a housing layout which differs from a conventional row housing layout in the following ways:

1. The shape and arrangement of the external spaces between the housing units, including the distribution of the public spaces and the pattern of the network of roads.

2. The shape of the individual housing lots, the relationship between adjoining housing lots and the potential for linkages between them.

3. The complex configuration of layout and patterns is made up of only the two basic triangular tile patterns.

Consistent with the expression tessellation, as described hereinafter, the basic hexagonal housing unit is referred to as a tile and the sub-units or elements which combine to form the tile shapes are called sub-tiles.

Figure 12:
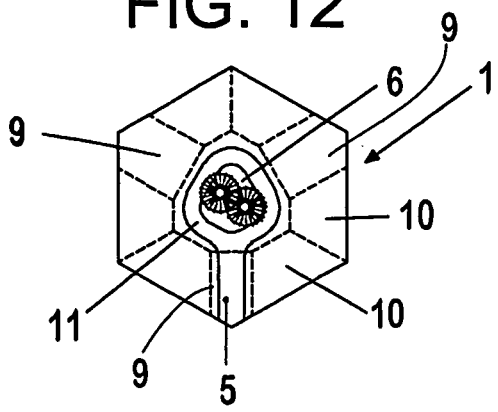
FIG. 12 shows an array of sub-tiles comprising the basic unit of FIG. 9.
Figure 13:
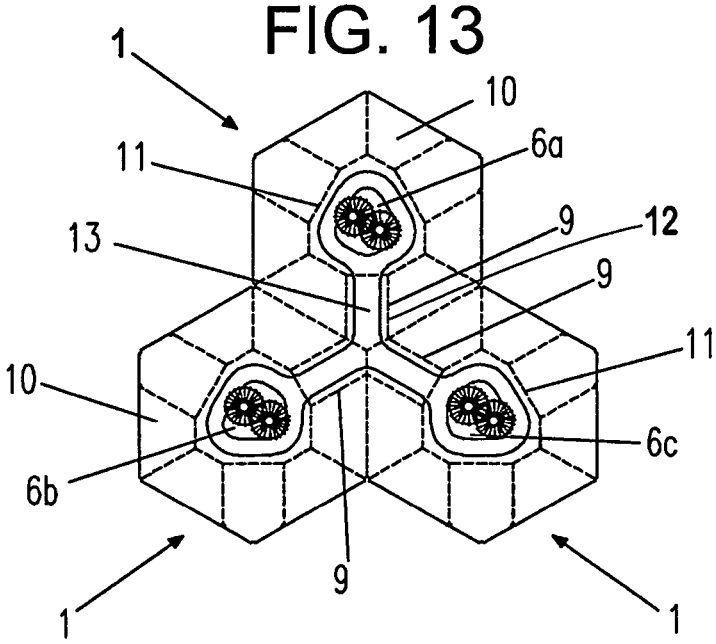
FIG. 13 shows the interconnection of inter-tiles in a tessellation.

FIG. 12 illustrates the basic hexagonal tile 1 of FIG. 9 as comprising an array of Type A sub-tiles 9, Type B sub-tiles 10 and a central sub-tile 11. As shown in FIG. 13, a Type A sub-tile 9 permits access to the housing units 3,4 (shown in FIG. 9) via service road 5 which loops around communal garden area 6 in the cul-de-sac neighbourhood unit represented by tile 1.

By designing tile 1 as shown in FIGS. 9, 11 and 12, this results in a basic neighbourhood unit comprising a group of houses 3,4, each clustered around a central courtyard or communal garden 5. Tile 1 can be replicated to form three interconnected neighbourhoods as shown in FIG. 13 wherein Type A sub-tiles 9 join with adjacent Type A sub-tiles 9 of adjacent tiles 1 to form a Y-shaped inter-tile 12. As shown, joining sub-tiles 9 permits the formation of a Y-shaped service road 13 that connects three courtyards 6*a*, 6*b*, 6*c*.

Figure 14:
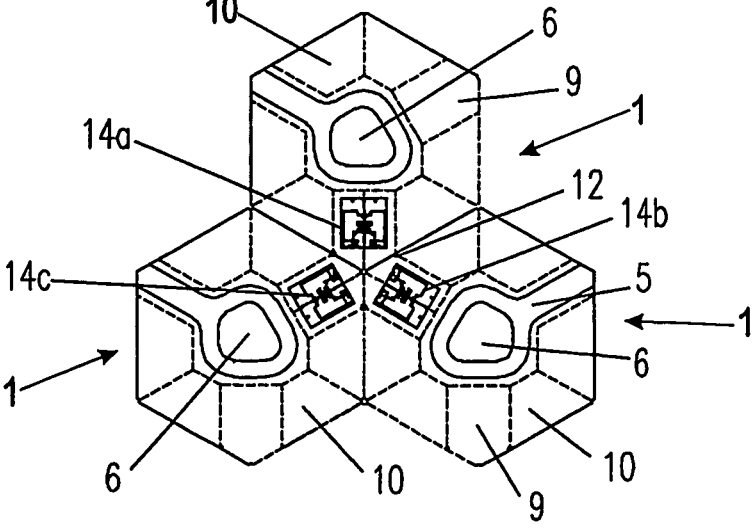
FIG. 14 shows an alternative configuration of inter-tiles.

FIG. 14 shows an alternative configuration of inter-tiles 12 wherein abutting Tube A sub-tiles 9 can be designed as three pairs of semi-detached houses 14*a*, 14*b*, 14*c*. As shown in FIGS. 13 and 14, abutting sub-tiles on adjacent tiles 1 can be joined to form interconnected sub-tiles or inter-tiles wherein an inter-tile may be described as an interconnected pattern which overlays the tessellated polygon comprised of a group of sub-divided portions of tiles 1 which abut.

Figure 15:
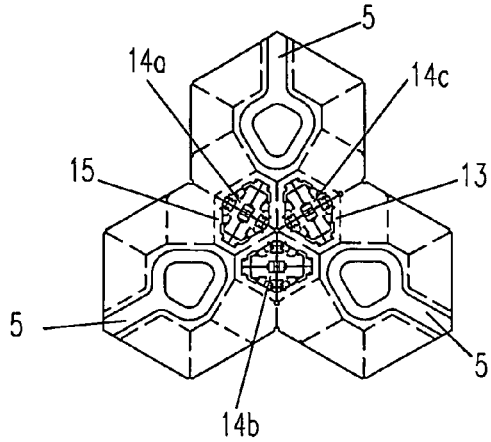
FIG. 15 shows another configuration of inter-tile.
Figure 16:
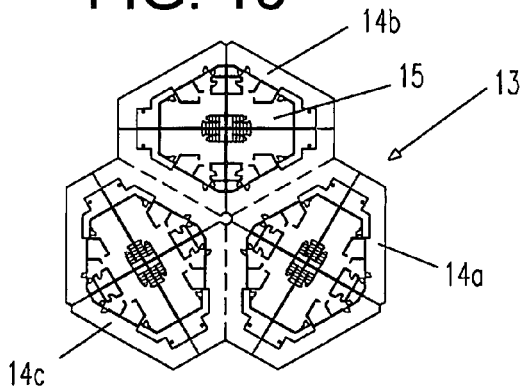
FIG. 16 shows enlarged views of the inter-tile of FIG. 15.

FIG. 15 shows how Type B sub-tiles 3 join up to form a trilobal inter-tile 13 incorporating three blocks 14*a*, 14*b*, 14*c* of twelve quadriplex houses 15. FIG. 16 shows an enlarged view of the inter-tile region 13 of FIG. 15.

Figure 17:
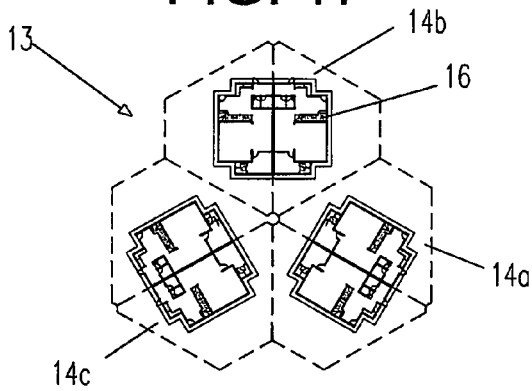
FIGS. 17 to 23 are enlarged views of alternative inter-tile configurations.
Figure 18:
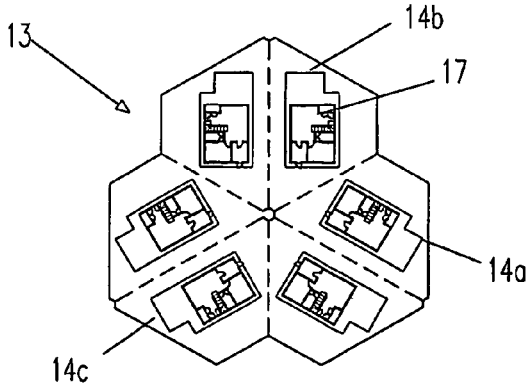

FIGS. 17 and 18 respectively show the inter-tile regions 13 with three blocks of six duplex houses 16 or semi-detached houses or with six units of detached houses 17.

Figure 19:
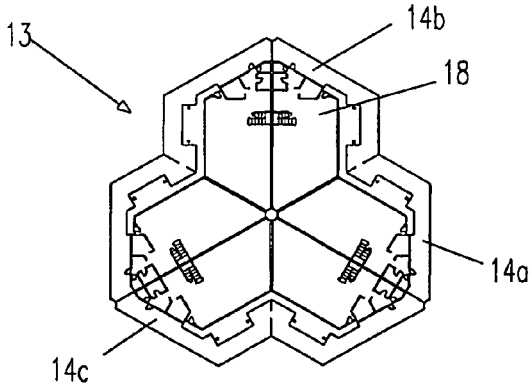
Figure 20:
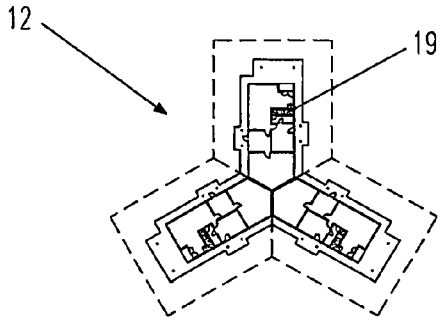
Figure 21:
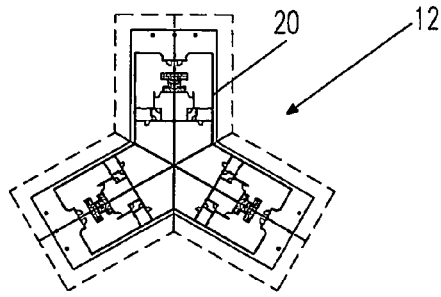

FIG. 19 shows yet another configuration of inter-tile region 13 representing a block of sextuplex housing units 18.

FIGS. 20 to 23 show alterative configurations of Y-shaped inter-tile region 12 having a single block of three units of triplex houses 19, a block of sextuplex housing units 20, three pairs of semi-detached houses 21 as shown in FIG. 14, and three sub-tiles as three detached houses or bungalows 22 respectively.

Figure 24:
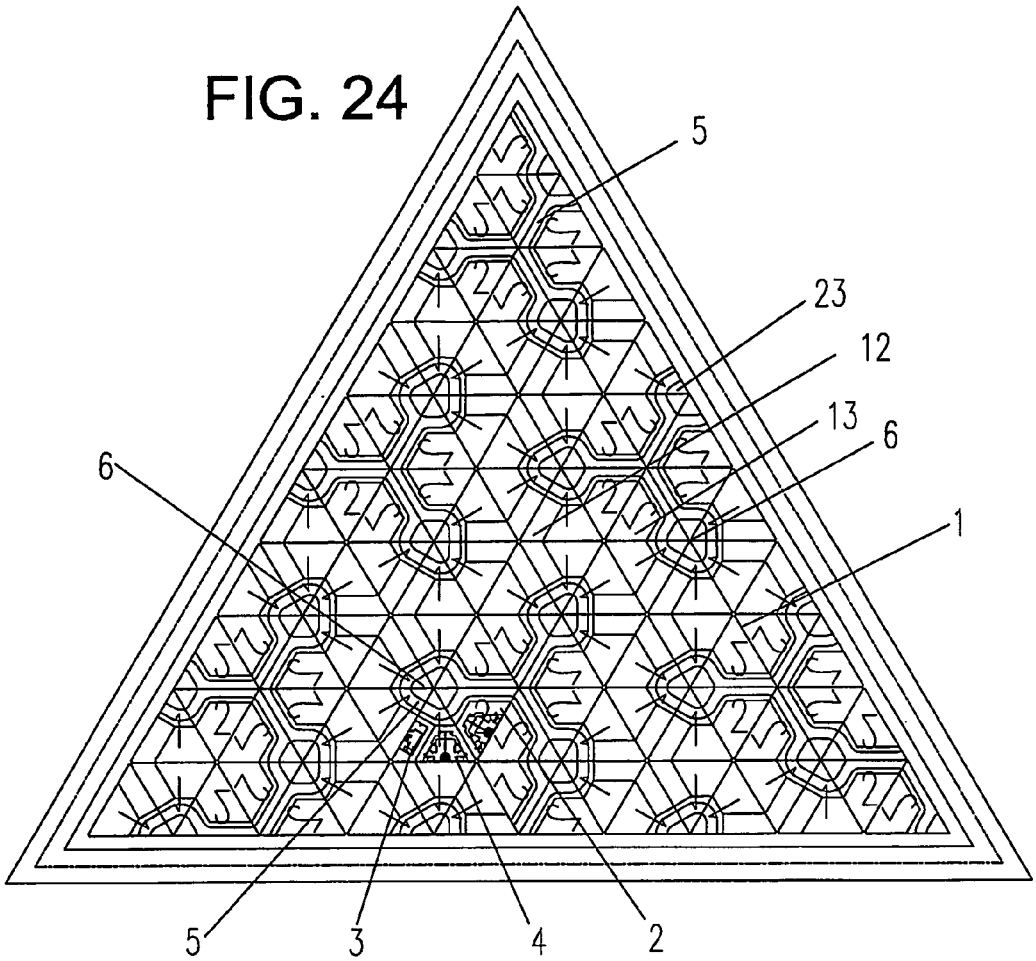
FIG. 24 illustrates a super-tile formed by a tessellation of tile units.
Figure 25:
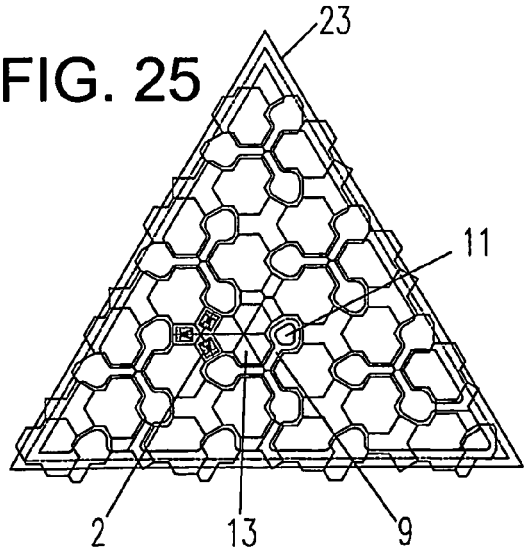
FIG. 25 shows schematically the interlocking elements of the super-tile of FIG. 24.
Figure 26:
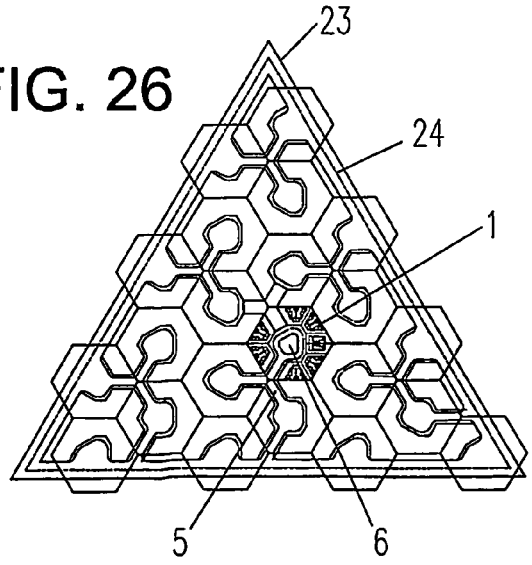
FIG. 26 shows schematically the super-tile of FIG. 24 as composed of hexagonal tile unit 1.

FIG. 24 illustrates a tessellation of basic hexagonal tile units 1 as shown in FIG. 9 wherein tiles may be grouped together to form the shape of a larger polygon 23, in this case a triangle, and by adjusting the design of the tiles at the boundaries and at other desired locations, may include the infrastructure and public amenity elements at the next higher level of hierarchy, including distribution roads, central play areas, place of worship, etc. to produce a larger neighbourhood or precinct. This larger polygon 23 is called a super-tile and for the sake of clarity, FIG. 25 shows the super-tile 23 of FIG. 24 as an interlocking jigsaw puzzle of inter-tiles 12 and 13 whereas FIG. 26 shows the super-tile 23 as a residential precinct developed from hexagonal basic neighbourhood units 1 surrounded by distribution roads 24.

Figure 27:
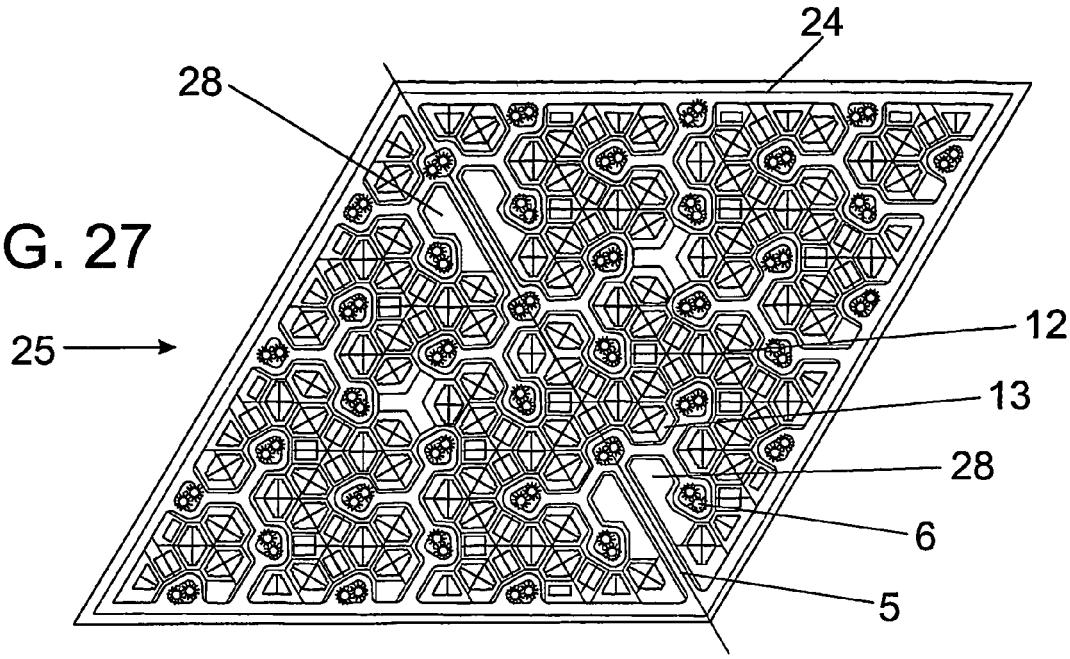
FIGS. 27 and 28 show alternative super-tile configurations.
Figure 28:
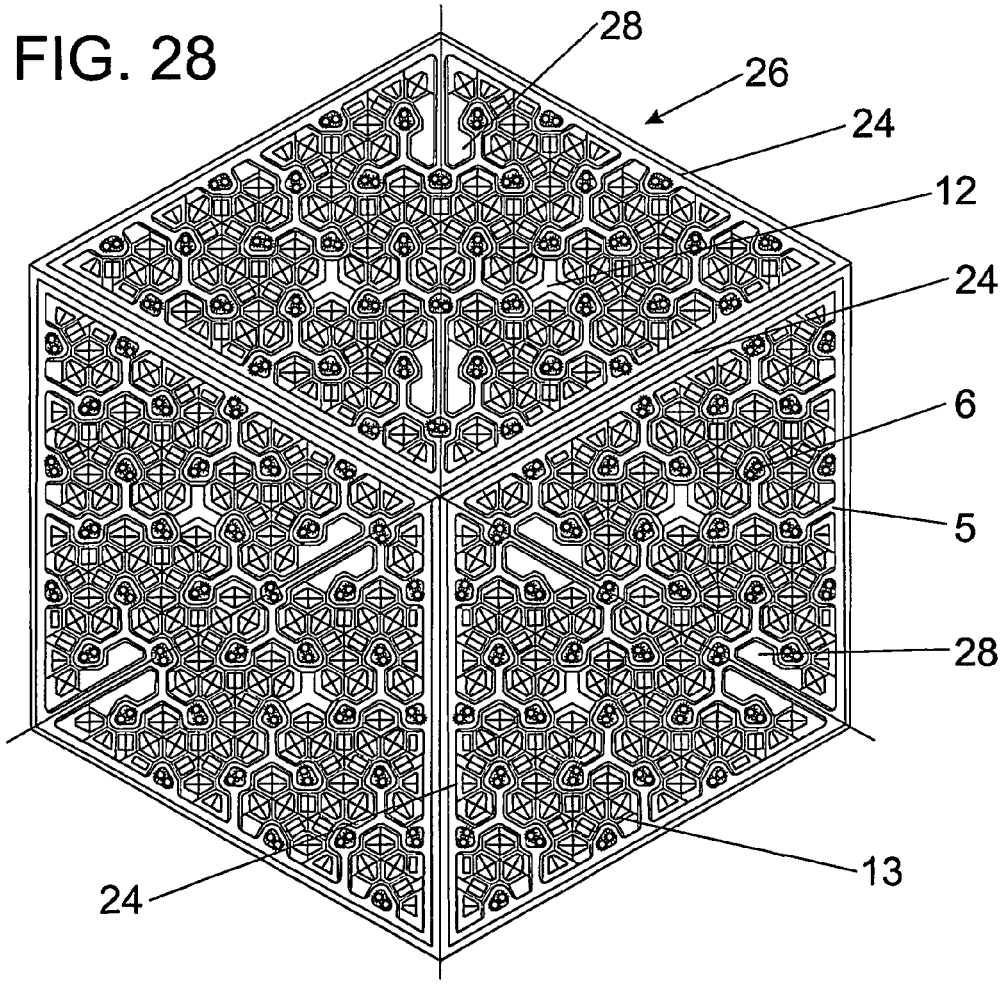

FIGS. 27 and 28 show more examples of super-tiles 25 and 26 respectively as a residential precinct. Such super-tiles may themselves be tessellated to forms groups of precincts that are the next hierarchical level of community in the planning of towns and may include community green spaces or parks 28.

Figure 22:
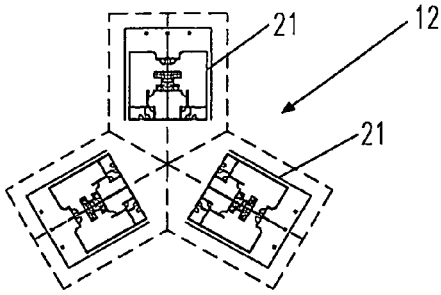
Figure 23:
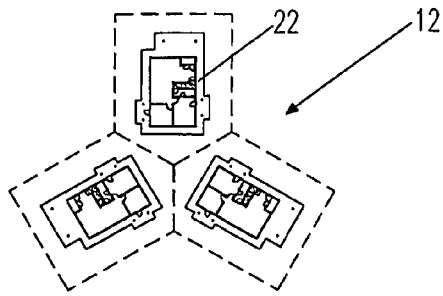

According to the planning method of the present invention, sites can be of arbitrary shape and may not fit in the row housing placed in an orthogonal gridline manner. Adjustments have to be made at the boundaries of the site. Similarly for this method of planning, special case adjustments have to be made at the edges of the site, as shown in the example given in FIG. 29 which represents a small site of approximately 40 acres. Super-tiles are not required in this example as the area may be tessellated with the basic neighbourhood units 1 as shown in FIG. 9 and employing a mixture of semi-detached houses 21 as shown in FIG. 22, semi-detached row houses 101 as shown in FIG. 2, quadriplex units 15 as shown in FIG. 15 and bungalows 100 as shown in FIG. 1. In the subdivision shown there are 393 housing units located on 37.1 acres giving an average density of 10.57 units/acre with a total green area of 5.6 acres. The subdivision comprises 72 semi-detached houses 21, 58 semi-detached row houses 101, 248 quadriplex units 15 and 14 bungalows 100. Suitably a main road 125 surrounds the subdivision 126.

Figure 30:
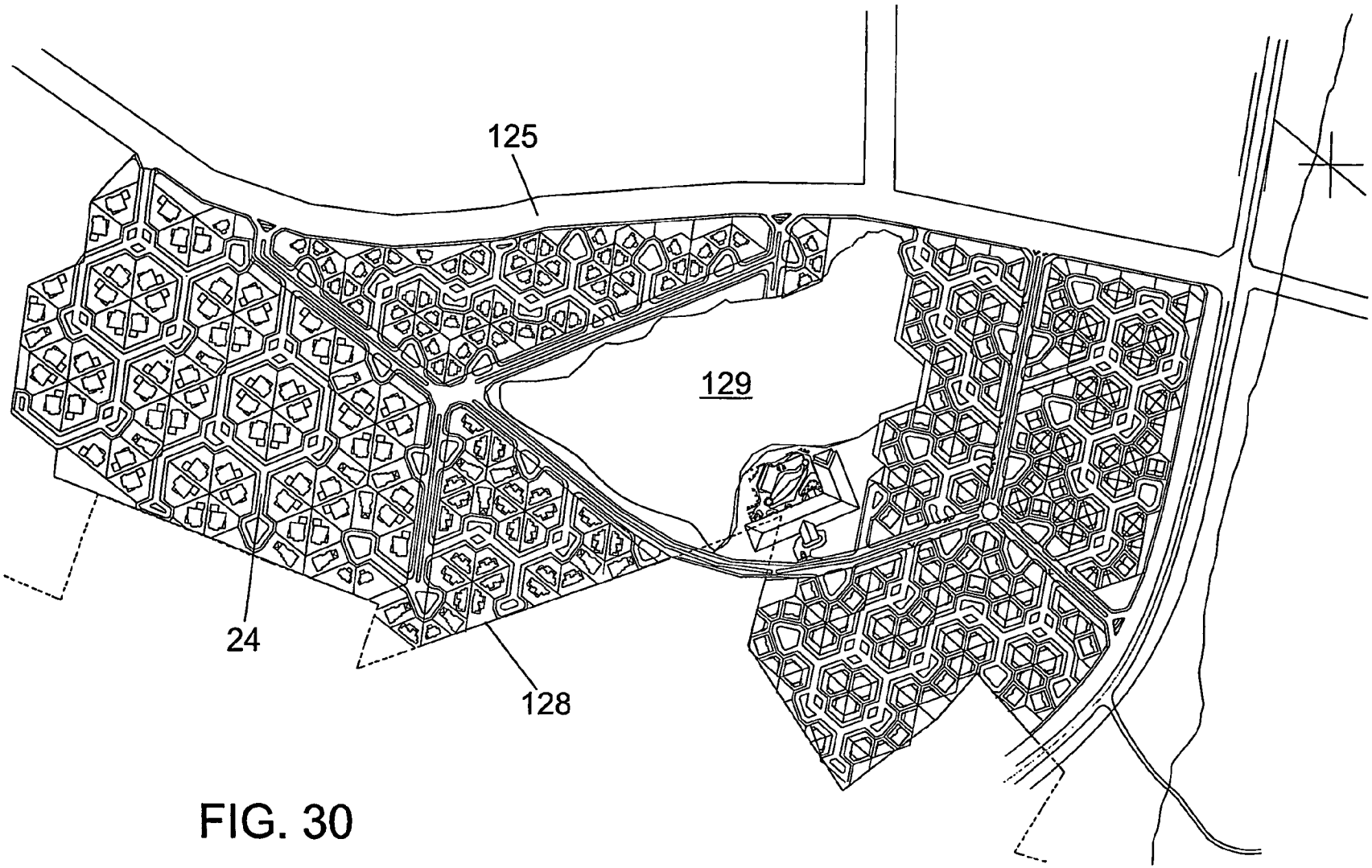

For larger areas such as that shown in FIG. 30, super-tiles 128 with elements of a higher hierarchy, including distribution roads 4, central pars 129, etc., are included.

Broadly speaking, the steps in the design method as described above can be summarized as follows:

i) Sub-unit tiles are designed to include the most basic elements of the house and access.

ii) The sub-unit tiles are tessellate to form a basic neighbourhood unit.

iii) The design is adjusted to include additional elements required for that level of community.

iv) The larger tile units containing the basic neighbourhood unit are tessellated to form a residential precinct.

v) The overall tessellated design or pattern is adjusted to include additional elements required for that level of community, and, vi) the above steps are repeated as necessary.

Linking the design intent to each step in the method of design provides a good way to describe the features of the repetitive housing produced. Studying in quantitative terms the design implications of tessellated housing and contrasting these against row housing provides another.

At a macro level a super-tile 23 such as that shown in FIG. 24 can become a basic tile unit. This basic tile unit 23 comprises housing units with a service road. This ensures all units have a public access reserve 26 which may be required by Land Laws pertaining to the subdivision of land.

Also included is a communal garden 6 for each housing cluster. The inventor believes that common play areas just outside the house gate is important in a child's environment especially at pre-school age.

The basic tile unit 23 as shown in FIG. 24 is triangular; one of the standard housing lots is a funnel shaped trapezium sub-unit 2 as shown in FIG. 9 and represented as a Type B sub-tile 10 as shown in FIG. 11. This is in contrast to the most efficient form of housing lot in row housing comprising a narrow frontaged rectangle. The implications of the geometry is discussed quantitatively further below.

Figure 31:
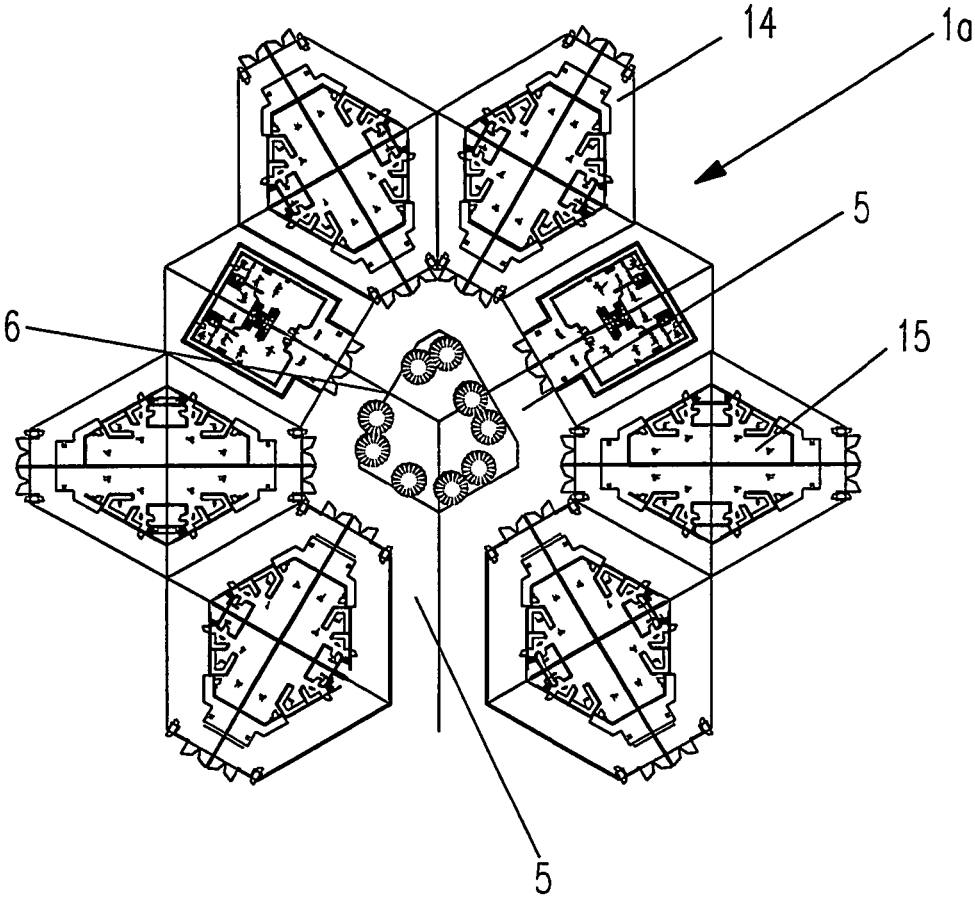
FIG. 31 shows a derived basic tile unit.

FIG. 31 shows basic neighbourhood unit 1*a* is derived from the hexagonal unit 1 as shown in FIG. 9. In this unit 1*a*, the blocks 14 of quadriplex houses 15 radiate outwardly beyond the hexagonal boundary of neighbourhood unit 1 shown in FIG. 9 and act as overlapping links to adjacent neighbourhood units 1*a* as shown in FIG. 32.

Figure 32:
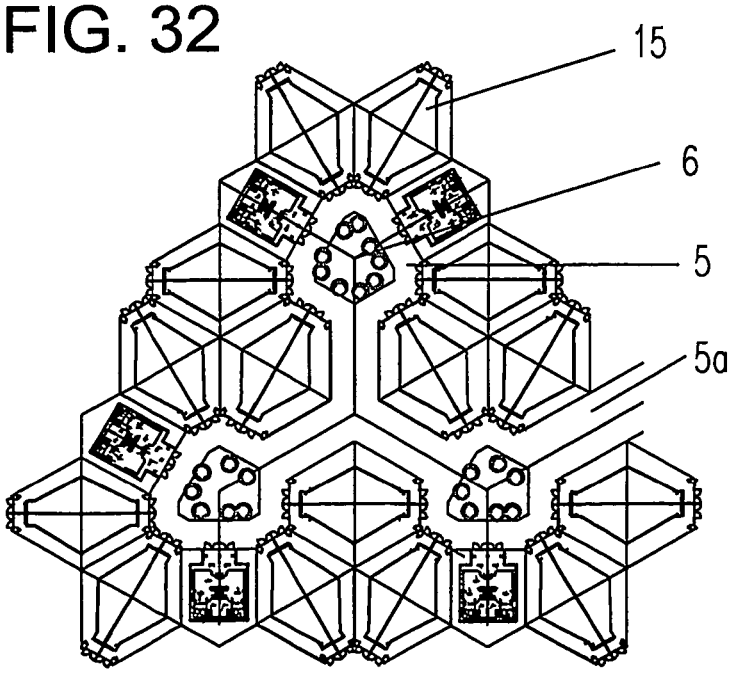
FIG. 32 shows the interconnection of derived basic tile units of FIG. 31.

In FIG. 32, a connecting service road 5*a* is required to link the cul-de-sac 5 to other neighbourhood units or to a distribution road. This is the basic road pattern employed in the tessellation technique according to the invention. Such a road pattern contrasts with that of the street in row housing but it is also different from cul-de-sacs that arise from row housing, not only in a qualitative sense but quantitatively as well.

Figure 33:
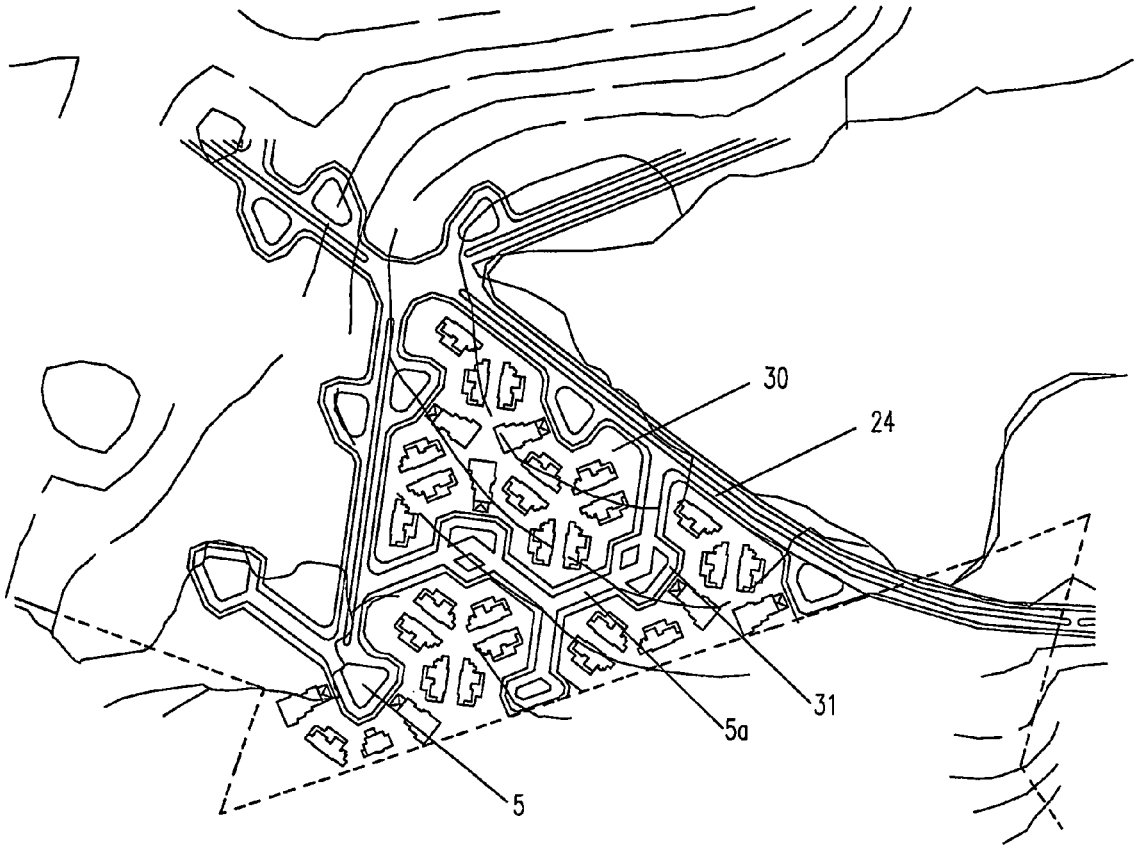
FIG. 33 shows an arrangement of roadways in a tessellated site development.

FIG. 33 shows tessellating the tiles comprising a basic neighbourhood unit creates an overlaying pattern 30 of inter-tiles. The inter-tiles that form the road network is composed of cul-de-sacs 5, roundabouts 31 and short stretches of connecting road 5*a*. In readily can be seen that such a network is effective in slowing down traffic.

There may be two types of inter-tiles containing housing land lots. The inter-tiles have different properties: the shape of the individual housing lots, the relationship between adjoining housing lots and the potential for linkages between them. The resulting house types thus are clearly different from the types of buildings found in row housing.

One aspect of the difference is that apart from the duplex houses, the linkages in tessellated housing are symmetrical in two axes. This means that there no long blocks, as in terrace houses.

Figure 34:
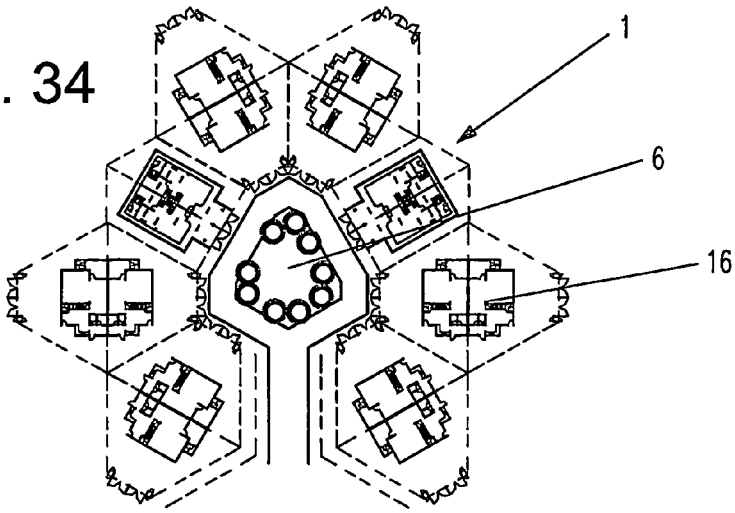
FIG. 34 shows a derived basic tile unit with duplex houses.

As illustrated in FIG. 34, for duplex houses 16, the natural axis of symmetry is back-to-back rather then side-to-side.

The next step in the design process is to incorporate additional elements required for a higher level of township or community hierarchy.

Public amenities such as parks, halls and other public buildings can be included in the neighbourhood precinct to meet the requirements of the larger community. Such amenities may in any case be compulsory under local Planning Regulations. These amenities may be incorporated in larger tiles, or super-tiles which in turn may be further tessellated to create a larger sub-division.

Figure 35:
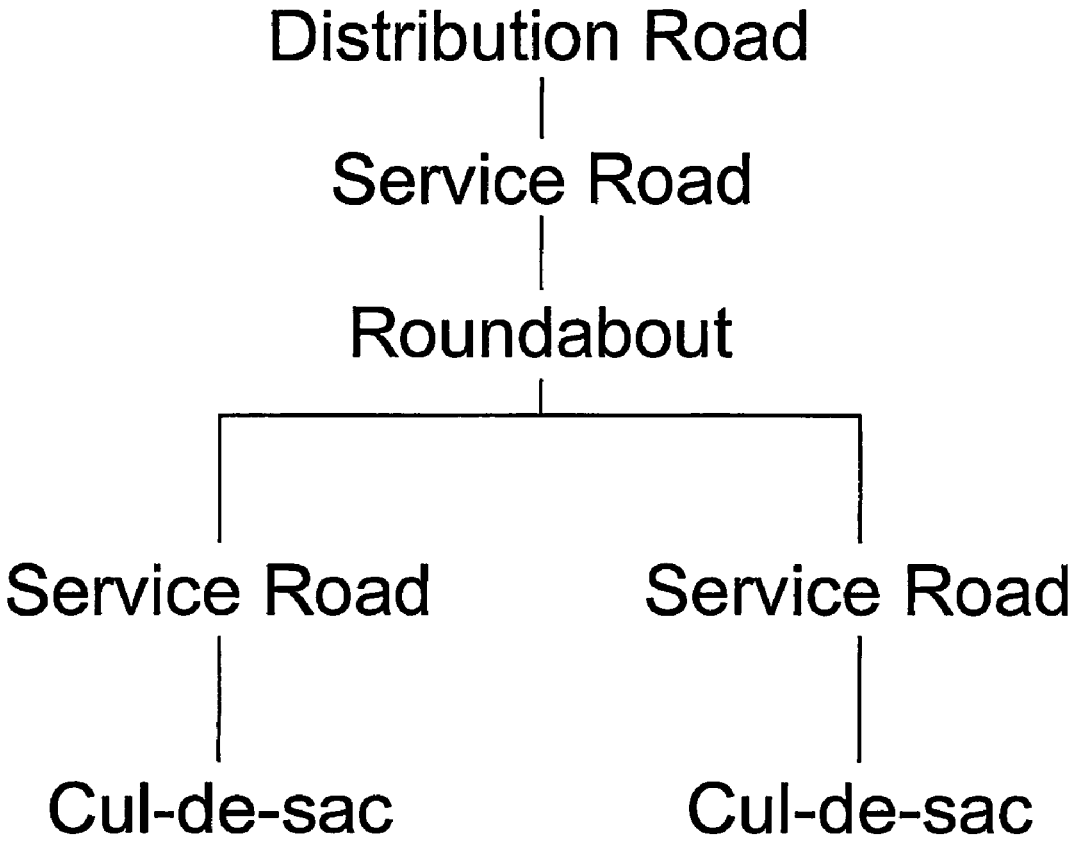
FIG. 35 shows the hierarchy of roads in a community development.

A typical hierarchical structure of community roads is shown in FIG. 35.

In the example of the tessellated layout shown in FIG. 33, the road network is dominated by short stretches of connecting roads 5*a*, roundabouts 31 and cul-de-sac 5 features that slow down traffic speed. This contrasts with that of existing road patterns arising from row housing. In fact, the higher the level of hierarchy, the greater the amount of traffic, and the greater the priority given to the car. At the lower level of the hierarchy, the pedestrian is given priority.

A road network may be considered as a structured hierarchy determined by levels of accessibility. The more accessible a place, the more public it is and conversely, the less accessible the place the more private it becomes. This structured hierarchy of public, semi-public and semi-private zones is an important feature achieved from structured tessellation planning and can create "defensible spaces" in the community sub-units.

Figure 36:
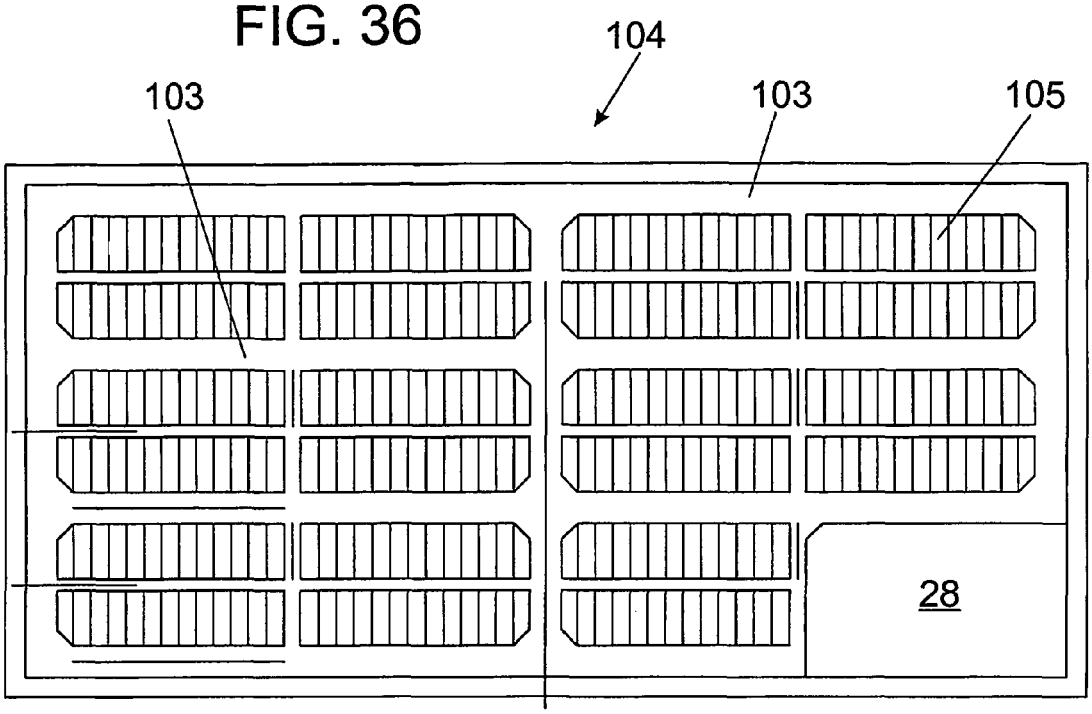
FIG. 36 shows a prior art terrace layout.

In Table 1, a tessellation layout on a 20-acre site is compared with that of terrace houses in a site of similar area. The layout of each scheme is according to their respectively most efficient forms, the row housing 104 with dwellings 105 being laid out in a rigid rectangular grid and a communal green space 28 as shown in FIG. 36, whereas the equivalent tessellated sub-divisional layout is shown in FIG. 24, the tessellated housing forming a triangle.

TABLE 1

| | TERRACE HOUSE | | TESSELLATION HOUSING | | MULTI-PLIER | QUADRIPLEX EQUIVALENT |
|---|---|---|---|---|---|---|
| | CORNER | 22 | QUADRIPLEX | 200 | ×1 | 200 |
| | INTERMEDIATE | 220 | DUPLEX | 42 | ×1.6 | 67 |
| | END | 22 | DETACHED | 5 | ×2 | 10 |
| TOTAL UNITS | | 264 Nos. | | 247 Nos. | | 277 Nos. |
| GREEN | 1.45 | Acres | | 1.7 | Acres | |
| ROAD | 9.47 | Acres | | 5.6 | Acres | |
| HOUSES | 9.94 | Acres | | 12.8 | Acres | |
| LAND AREA | 20.86 | Acres | | 20.8 | Acres | |
| DENSITY | 12.77 | Unit/ Acres | | 12.3 | Unit/ Acres | |

The results may be summarized as follows:

i) The land use efficiency in a tessellation system is greatly increased.

ii) The absolute number of units in the tessellation layout is less than that of the rows housing, but its effective density in terms of "quadriplex equivalents" is much higher when the duplex is taken to be equivalent to 1.6 quadriplex houses, and the tessellation detached unit is taken as equivalent to two duplex units.

Figure 37:
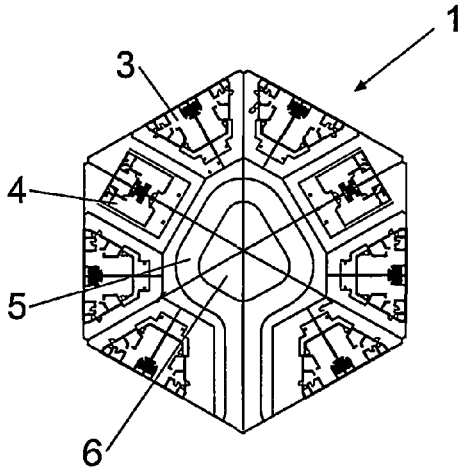
FIGS. 37 and 38 show respectively 16 unit tessellated and terrace layouts.
Figure 38:
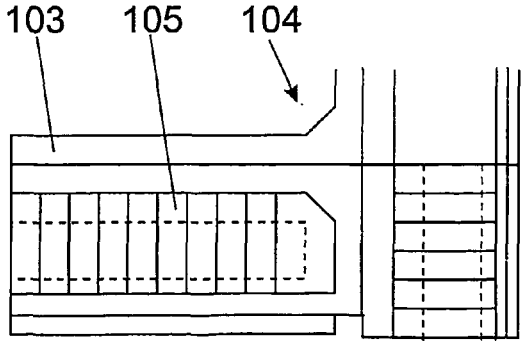

FIG. 37 shows a basic neighbourhood unit 1 comprising 16 units of quadriplexes 3 and duplexes 4 compared with a terrace house arrangement 104 of an equivalent 16 units of terrace houses 105 in FIG. 38. Table 2 below shows that the tessellated layout is more land-use efficient

TABLE 2

| 16 UNIT COMPARISON | | | | |
|---|---|---|---|---|
| | TESSELLATED HOUSE | | TERRACE HOUSE | |
| | (SM) | (%) | (SM) | (%) |
| ROAD | 879 | 23% | 1,239 | 34% |
| GREEN | 264 | 7% | 269 | 7% |
| HOUSE | 2,721 | 70% | 2,190 | 59% |
| TOTAL | 3,864 | 100% | 3,698 | 100% |

Figure 39:
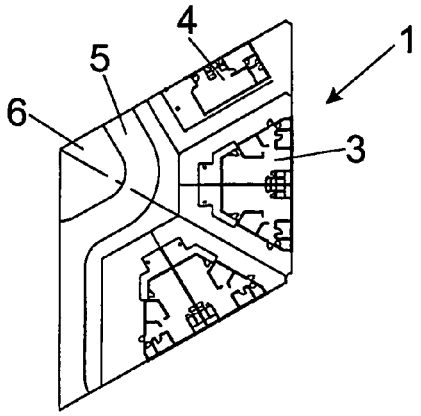
FIGS. 39 and 40 show respectively 5 unit tessellated and terrace layouts.
Figure 40:
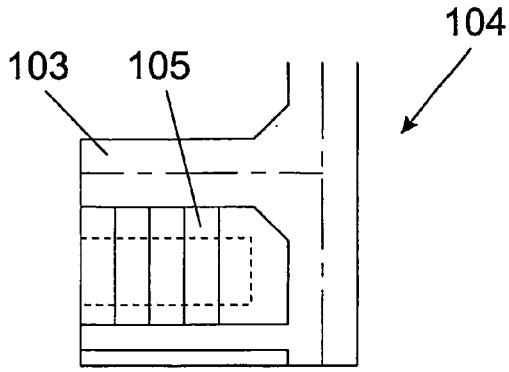

FIGS. 39 and 40 illustrate a smaller 5 unit comparison and Table 3 again shows that the tessellated layout is more efficient with less roads but more land for houses

TABLE 3

| 5 UNIT COMPARISON | | | | |
|---|---|---|---|---|
| | TESSELLATED HOUSE | | TERRACE HOUSE | |
| | (SM) | (%) | (SM) | (%) |
| ROAD | 334 | 26% | 611 | 41% |
| GREEN | 93 | 7% | 103 | 7% |
| HOUSE | 861 | 67% | 761 | 52% |
| TOTAL | 1,288 | 100% | 1,457 | 100% |

Figure 41:
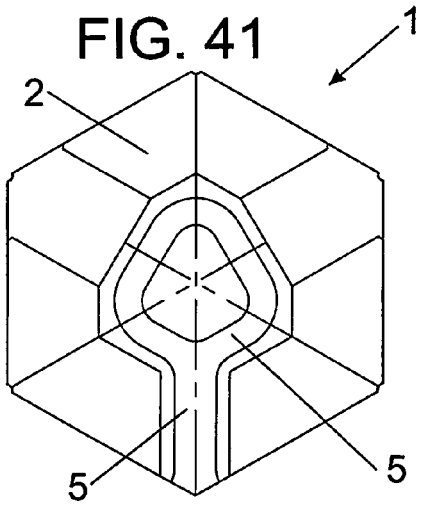
FIGS. 41 and 42 show respectively 8 unit detached tessellated and terrace layouts.
Figure 42:
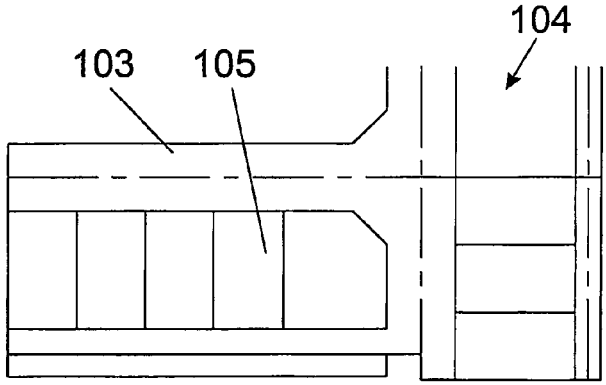

FIGS. 41 and 42 respectively show a comparison between 8 units of tessellated detached units and 8 units of equivalent detached houses in a row layout, and yet again Table 4 shows that the tessellated layout is more efficient.

TABLE 4

| 8 BUNGALOWS COMPARISON | | | | |
|---|---|---|---|---|
| | TESSELLATED LAYOUT | | ROW LAYOUT | |
| | (SM) | (5) | (SM) | (%) |
| ROAD | 879 | 23% | 903 | 27% |
| GREEN | 264 | 7% | 235 | 7% |
| HOUSE | 2,721 | 70% | 2,190 | 66% |
| TOTAL | 3,864 | 100% | 3,328 | 100% |

Figure 43:
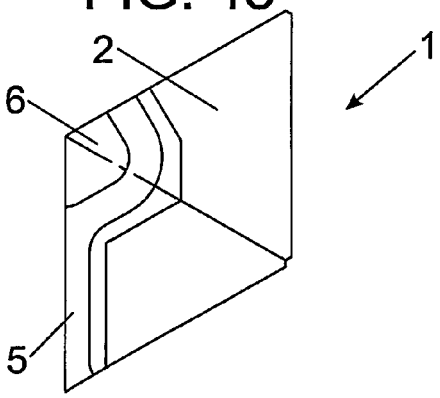
FIGS. 43 and 44 show respectively 2 unit tessellated and terrace layouts.
Figure 44:
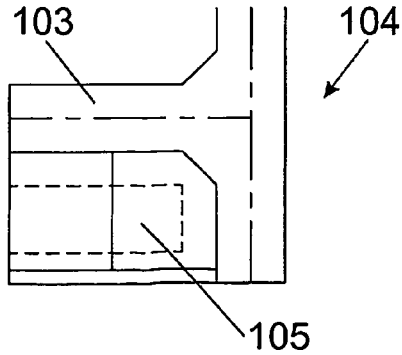

Even in a two dwelling comparison involving 2 tessellated detached houses and 2 rows detached houses shown in FIGS. 43 and 44, the tessellated layout is the more efficient as indicated in Table 5.

TABLE 5

| 2 BUNGALOWS COMPARISON | | | | |
|---|---|---|---|---|
| | TESSELLATED LAYOUT | | ROW LAYOUT | |
| | (SM) | (%) | (SM) | (5) |
| ROAD | 334 | 26% | 426 | 33% |
| GREEN | 93 | 7% | 103 | 8% |
| HOUSE | 861 | 67% | 761 | 59% |
| TOTAL | 1,288 | 100% | 1,290 | 100% |

The advantages of the method according to the present invention may be illustrated by a consideration of prior art sub-divisional systems.

Figure 45:
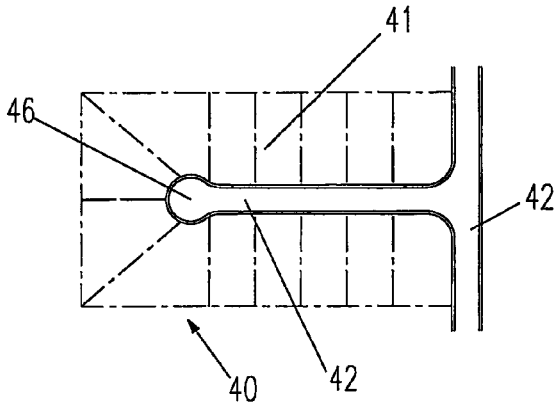
FIG. 45 shows one form of prior art cul-de-sac layout.

FIG. 45 shows a cul-de-sac layout 40 is a special case of a row of houses 41 surrounding an access road 42 connected to a distributor road 43. A cul-de-sac arrangement is more efficient when compared to row housing with through roads, but this advantage is slight and is counter-weighed by the inconvenience caused to drivers who enter the dead end 46 and have to turn out again.

Figure 46:
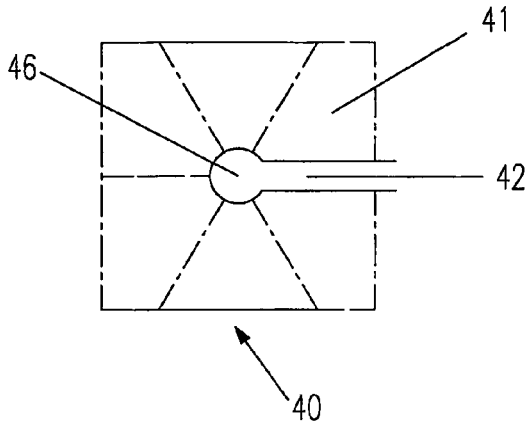
FIG. 46 shows an alternative form of prior art cul-de-sac layout.

This road can be reduced by shortening the service road as shown in FIG. 46. However, this results in an uneven distribution of land area and shape as found in existing cul-de-sac developments. These odd-shaped lots are not considered desirable, and as such, makes such developments comparatively rare.

Figure 47:
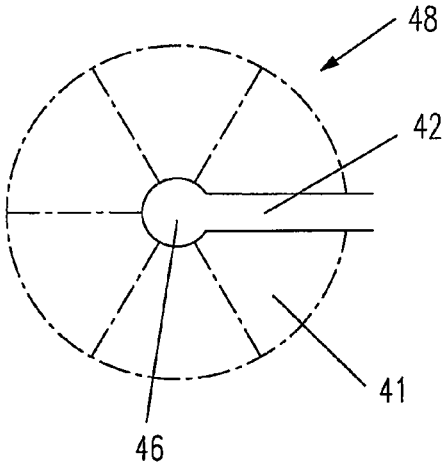
FIG. 47 shows a prior art circular cul-de-sac.
Figure 48:
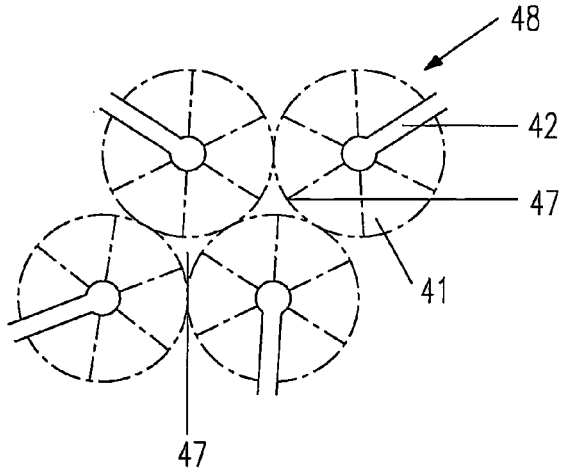
FIG. 48 shows an attempt to tessellate the circular cul-de-sac layouts of FIG. 47.

FIG. 47 shows that an even distribution of land area and shape is achievable by having the cul-de-sac formed from a circular plot of land 48 but while permitting efficient subdivision with access provided to each residential lot as shown in FIG. 48 the circular plots do not permit tessellation and either wasted space 47 or irregular shaped lots result.

Developing further from the comparison between the tessellation housing layout and the terrace-housing layout, the dimensions of the lots are expressed as variables and the ratio of road to green to house is calculated as formulas and land-use efficiency defined as follows:

$$\text{Land Use efficiency} = \frac{\text{House}}{\text{Road} + \text{Green} + \text{House}}$$

where

House = total area of residential lots

Green = total area of green space

Road = total road area

Figure 49:
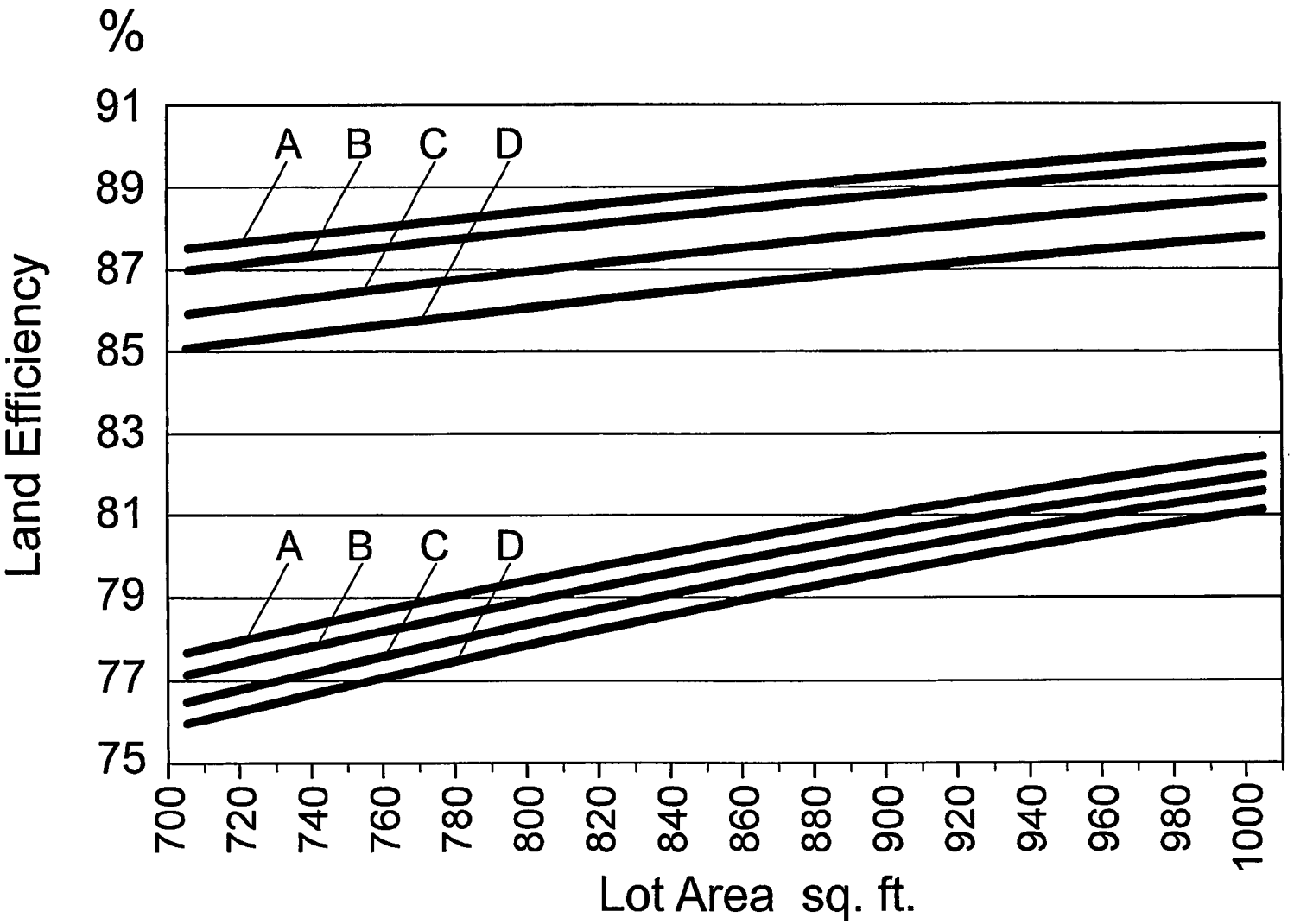
FIG. 49 shows a graphical comparison of tessellated and prior art terrace layout efficiencies.

The land-use efficiency of both tessellated and terrace housing is compared across varying lot sizes and frontages. It is seen that the efficiency of the terrace house layout improves when the frontage is made narrower and narrower as shown in FIG. 49 wherein the upper curves represent tesselar housing and the lower curves represent terrace housing, both having frontages where A=18 ft, B=20 ft, C=22 ft and D=24 ft.

To maximize usage of that land, the building itself must also follow or approximate the funnel shape of the land. The geometry of the most efficient building form on a funnel shaped land contrasts with that of a rectangular land.

For example, a typical bungalow lot of 557.6 sm in a conventional layout is compared with a typical bungalow lot of same size in a tessellated layout. Both typical lots are subjected to local government setback requirements to arrive at the maximum footprint allowable.

Figure 51:
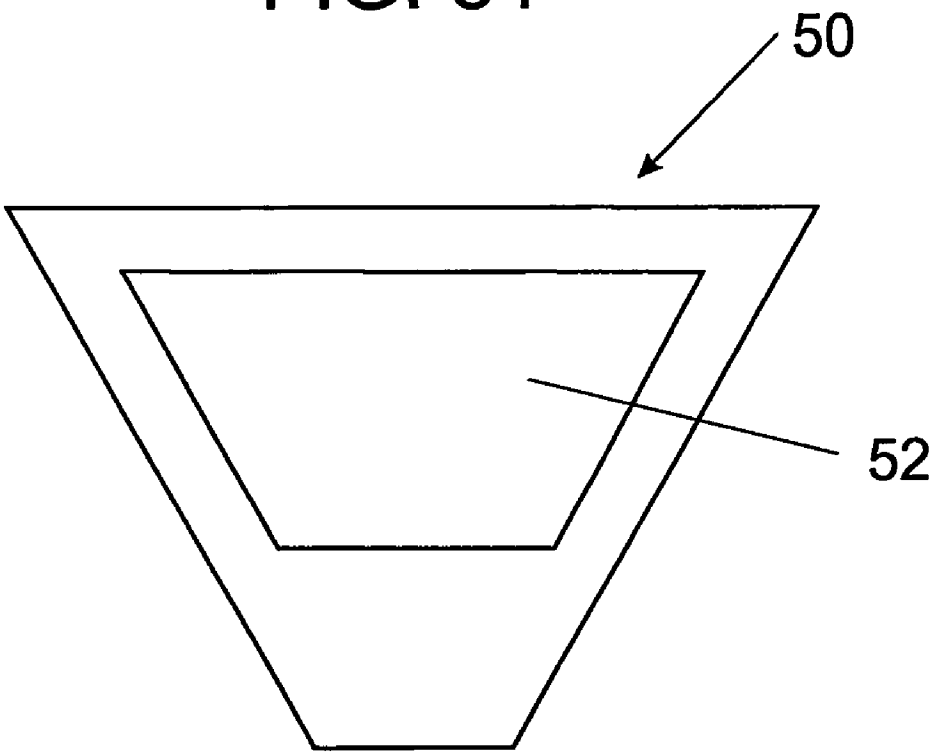
FIGS. 50 to 51 compare respective visual attributes of houses on a rectangular bungalow lot and a tessellated bungalow lot.
Figure 50:
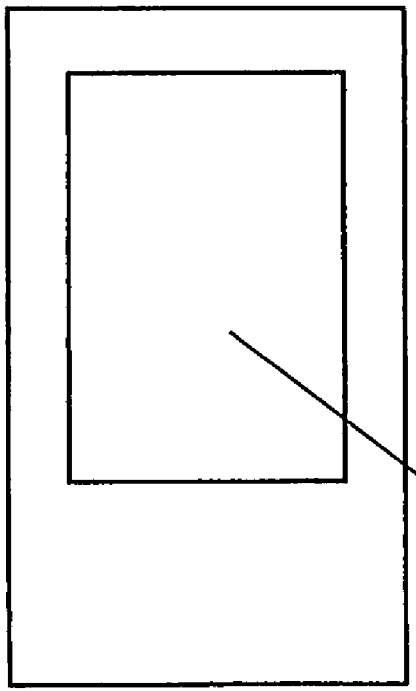

In FIG. 51, the maximum plinth area 52 of a tessellated bungalow lot 50 is 233.3 sm compared to the conventional bungalow plinth area 51 of 223.0 sm as shown in FIG. 50. This represents a 4.6% increase amounting to 10.3 sm.

Figure 29:
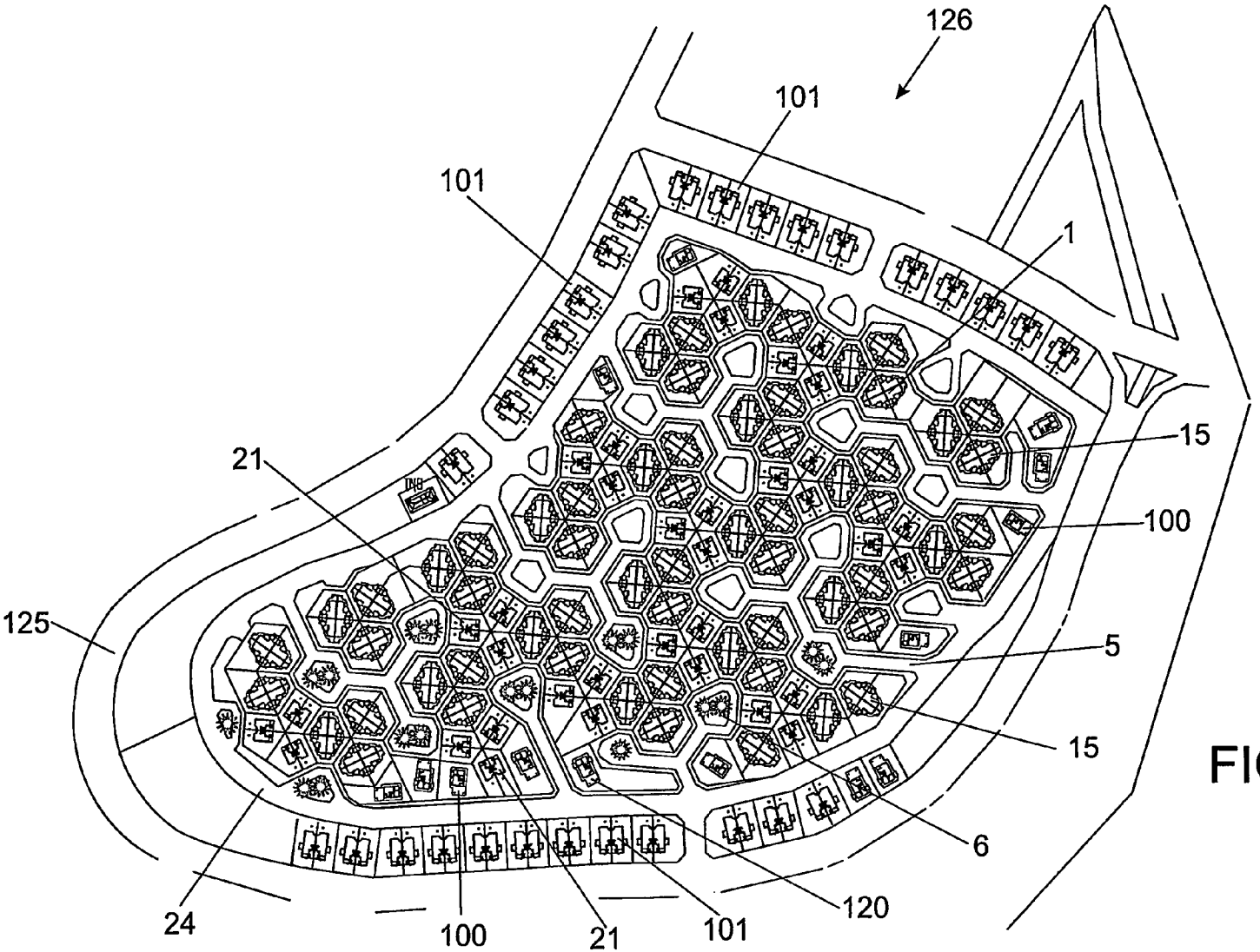
FIGS. 29 and 30 show tessellation patterns for site development.
Figure 52:
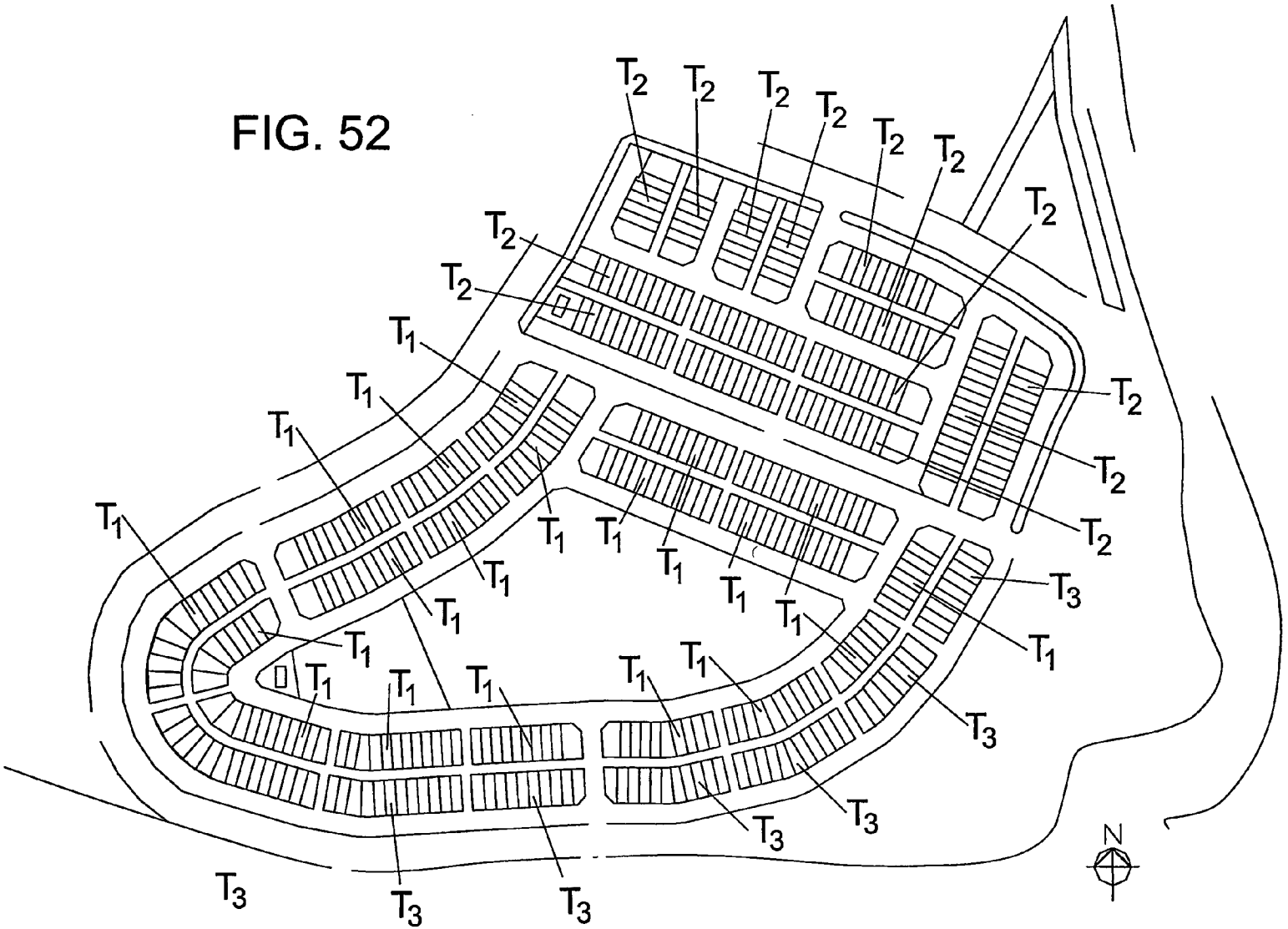
FIGS. 52 and 53 respectively show a terrace house and a tessellated sub-division of the same development site.

Table 6 represents a comparative feasibility study between a conventional terrace-housing layout and equivalent tessellated housing layout on the same site represented respectively in FIGS. 52 and 29.

In the layout of FIG. 52, the total land area is 37.1 acres comprising 5.6 acres of green space and 186 Type 1 terrace houses, 150 Type 2 terrace houses and 88 Type 3 terrace houses giving a density of 11.43 units/acre for a conventional terrace row housing development.

In contrast, the layout of FIG. 29 shows a tessellation layout which permits on the same total land area of 37.1 acres comprising 5.6 acres of green space, 72 semi-detached houses 21, 58 semi-detached houses 101, 248 quadriplex units 15 and 14 bungalows 100 giving a density of 10.57 units/acre.

In this comparison, differences in saleable land areas are taken into account as is savings in construction cost for infrastructure. Thus in this example, only the advantages of tessellation housing due to its land-use efficiency is taken into account. Using conservative estimates of the reduction in the cost of infrastructure, the value-added to the project by the tessellation layout is already 6% of the development cost. A more realistic study taking into account the full extent of the advantages of tessellation housing in terms of saleable value and cost can easily double the added value.

TABLE 6

| TERRACE HOUSING LAYOUT | | | | | TESSELLER HOUSING LAYOUT | | | | |
|---|---|---|---|---|---|---|---|---|---|
| 1.0 SALES | | Unit | Price/ Unit | (RM) | NOTE | UNIT | COST/ UNIT | (RM) | |
| 1.1 Terrace House Type 1 | | 186 | 202,000 | 37,572,000 | | 0 | | 0 | 1 |
| 1.2 Link House Type 2 | | 150 | 202,000 | 30,300,000 | | 0 | | 0 | 2 |
| 1.3 Terrace House Type 3 | | 88 | 222,200 | 19,553,600 | | 0 | | 0 | 3 |
| 1.4 Quarter Detached | | 0 | | 0 | | 248 | 208,000 | 51,584,000 | 4 |
| 1.5 Semi Detached Type 1 | | 0 | | 0 | | 72 | 223,000 | 16,056,000 | 6 |
| 1.6 Semi Detached Type 2 | 2244769.9 sf@ RM25PSF | 0 | | 0 | | 58 | 300,000 | 17,400.00 | |
| 1.7 Bungalow | 72745 sF@RM40psf | 0 | | 0 | | 14 | 420,000 | 5,880,000 | 7 |
| TOTAL COST | | 424 | | 87,425,600 | | 392 | | 90,920,000 | 8 |

TABLE 6-continued

| 2.0 | CONSTRUCTION COST | | | | COST/ | | | | | COST/ | | |
|---|---|---|---|---|---|---|---|---|---|---|---|---|
| 2.1 | Building Costs | UNIT | RM/SF | SF | UNIT | | UNIT | RM/SF | SF | UNIT | | |
| 2.1.1 | Terrace House Type 1 | 186 | 45 | 2,000 | 90,000 | 16,740,000 | 0 | | | | 0 | 9 |
| 2.1.2 | Link House Type 2 | 150 | 45 | 2,000 | 90,000 | 13,500,000 | 0 | | | | 0 | 10 |
| 2.1.3 | Terrace House Type 3 | 88 | 45 | 2,000 | 99,000 | 8,712,000 | 0 | | | | 0 | 11 |
| 2.1.4. | Quarter Detached | 0 | | | | | 248 | 45 | 2,000 | 90,000 | 22,320,000 | 12 |
| 2.1.5 | Semi Detached Type 1 | 0 | | | | | 72 | 50 | 2,000 | 100,000 | 7,200,000 | 13 |
| 2.1.6 | Semi Detached Type 2 | 0 | | | | | 58 | 50 | 2,400 | 120,000 | 6,960,000 | 14 |
| 2.1.7 | Bungalow | 0 | | | | | 14 | 55 | 3,000 | 165,000 | 2,310,000 | 15 |
| TOTAL | | | | | | 38,952,000 | | | | | 38,790,000 | 16 |
| 2.2 | INFRASTRUCTURE | UNIT | RM/SF | ACRES | (RM) | | UNIT | RM/SF | ACRES | (RM) | | |
| 2.2.1 | Earthworks | | | 37.1 | 20,000 | 742,000 | | | 37.1 | 18,000 | 667,800 | 17 |
| 2.2.2 | Drainage | | | 37.1 | 20,000 | 742,000 | | | 37.1 | 19,000 | 704,900 | 18 |
| 2.2.3 | Road | | | 37.1 | 20,000 | 742,000 | | | 37.1 | 19,000 | 704,900 | 19 |
| 2.2.4 | Sewerage Reticulation | 424 | | | 2,000 | 848,000 | 392 | | | 2,000 | 784,000 | 20 |
| 2.2.5 | Water Reticulation | 424 | | | 600 | 254,400 | 392 | | | 600 | 235,200 | 21 |
| 2.2.6 | Telecom | 424 | | | 200 | 84,800 | 392 | | | 200 | 78,400 | 22 |
| 2.2.7 | Road Lighting | 424 | | | 300 | 127,200 | 392 | | | 300 | 117,600 | 23 |
| 2.2.8 | Landscape | | | 37.1 | 5,000 | 185,500 | | | 37.1 | 5,000 | 185,500 | 24 |
| TOTAL CONSTRUCTION COST | | | | | | 42,677,900 | | | | | 42,268,300 | 25 |
| 3.0 | OTHER DEVELOPMENT COST | | | | | | | | | | | |
| 3.1 | Consultant Fee @ 8% of Construction Cost | | | | | 3,414,232 | | | | | 3,381,464 | 26 |
| 3.2 | Management Fee @ 10% of Construction Cost | | | | | 4,267,790 | | | | | 4,226,830 | 27 |
| 3.3 | Contribution | | | | | | | | | | | |
| | JPP | 424 | | | 2,000 | 848,000 | 392 | | | 2,000 | 784,000 | 28 |
| | TNB | 424 | | | 2,000 | 848,000 | 392 | | | 2,000 | 784,000 | 29 |
| | JPS (Acres) | | | 37.1 | 4,000 | 148,400 | | | 37.1 | 4,000 | 148,400 | 30 |
| | ISF | 424 | | | 800 | 339,200 | 392 | | | 800 | 313,600 | 31 |
| | JBA | 424 | | | 1,000 | 424,000 | 392 | | | 1,000 | 392,000 | 32 |
| 3.4 | Land Cost | | | | | 19,392,912 | | | | | 19,392,912 | 33 |
| | DEVELOPMENT COST LESS INTEREST | | | | | 72,360,434 | | | | | 71,691,506 | 34 |
| 3.5 | Financial Cost (Cost × 20% × 11/2 Year @ 13%) | | | | | 1,280,337 | | | | | 1,268,049 | 35 |
| | TOTAL DEVELOPMENT COST | | | | | 73,640,771 | | | | | 72,959,555 | 36 |
| | GROSS PROFIT | | | | | 13,784,829 | | | | | 17,960,445 | 37 |
| | PROFIT/DEVELOPMENT COST | | | | | 18.73% | | | | | 24.62% | 38 |

It will be readily apparent to a person skilled in the art that the land subdivision processes according to the invention offer substantial advantages over conventional rectangular grid-like subdivisions, not only in terms of improved profitability to developers but, more importantly, in terms of improved amenity for site occupants.

Town planners describe simple geometric grids as being "bad" forms of subdivision.

The reasons for this are complex and associated with aesthetics, traffic control, crime prevention and other social factors.

What Town Planners want to see in a subdivision is a non-linear layout. Straight lines are perceived as being bad for neighbourhood, traffic, bad socially, bad in terms of crime prevention and aesthetically sterile.

Automated land division is easy with a simple grid which can be expressed mathematically according to a set of rules provided by the developer and controlled by rules set by local authorities. The rules with which the automation process is most often driven are related to road widths, plot size, frontage and buildable area. Buildable area is related to plot dimensions and a series of rules most of which are set back rules.

The formulae that arise within an automated system for simple orthogonal grids are all linear. All areas are calculated as simple squares or rectangles, and are relatively simple to understand and operate. They are so simple that it is possible to arrive at economic solutions using simple manual iteration.

When the subdivision is non-orthogonal, automation of this sort is difficult. Some of the formulae that drive these relationships are quadratic. It is no longer possible to investigate the relationships between plot size frontage, and setbacks using a few iterations, and real mathematics must be used to investigate economic solutions.

The reason that quadratics come into play is that most plot areas or buildable areas are partly square or rectangular and partly triangular often expressed as:

AREA=*AX* squared,plus *BX*,(not simply AREA=*AX* which is usually the case for an orthogonal grid)

Which becomes 0=AX squared, plus BX, minus AREA

The solution to the quadratic equation of this sort is X=−B, plus or minus (the square root of (B, minus, 4 multiplied by A, multiplied by minus AREA))—all divided by 2 multiplied by A If the subdivision design is standardized, that is, it becomes repeatable but non-orthogonal, the problems identified by planners associated with orthogonal grids are avoided but it is still possible to drive the mathematical evaluation relatively simply.

A further aspect of this invention will be to develop such a system and imbed it in packages that can be used by other designers. Such a package would include:

Tile Optimization

This feature will allow the operator to create a tile using the following inputs:

Tile type
S Road width
Green space as percentage of tile
Front setback
Rear setback
Side setback
Single dwelling, duplex, quadruplex, sexplex
Single, double or triple story
Built up area required Using these inputs, the software will create the optimum tile. Operator will be able to manually adjust to modify the automatically generated tile.

Site Tiling

After setting out the site on AutoCAD (or similar drafting package), a simple command "tile" will create an overall pattern. The pattern will automatically be created with the greatest number of complete tiles possible on the site. Roads will be created using mouse commands rotating and/or linking individual tiles.

Best Fit Edges

A best fit command will automatically create all possible perimeter blocks by combining unusable truncated pieces with others or attaching them to other blocks.

A printout of overall development statistics will then be available which includes:

Gross site area
Total road area
Total green area
Total saleable land area
Total number of lots
Total number of bungalow lots
Total number of duplexes
Total number of quadruplexes
Total number of sexplexes Operator can manually adjust best fit solutions and modify grid positioning to check for more optimal solutions.

Levels

By overlaying the site contours, the software will provide the best arrangement of platform levels for each lot, controlling the cut and fill sections to balance.

Other design and quantity surveying costing tools can be added to create very user-friendly software packages.

An example of an automated tessellation of a plot of land to establish subdivisional boundaries is illustrated in additional drawing FIGS. 53 to 58.

Figure 53:
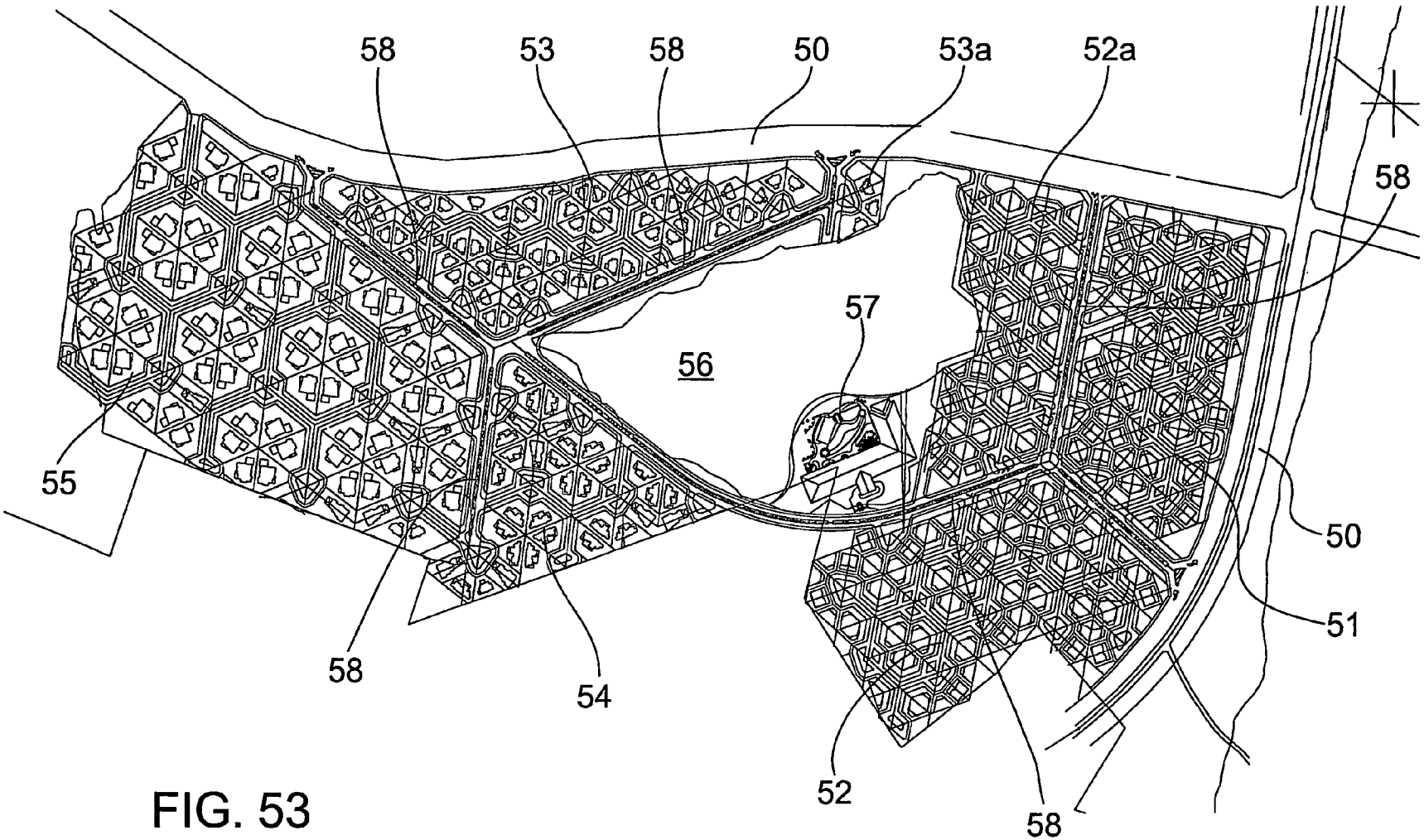

In FIG. 53, the land to be subdivided is bounded on two sides by existing main roads 50 and comprises five separate precincts 51, 52, 53, 54 and 55 surrounding a central lake or pond 56 and a communal facility such as a clubhouse 57. Precincts 51, 52, 53, 54 and 55 are separated by pathways 58 and portions of precincts 52 and 53 are intersected by pathways 58 to form sub-precincts 52*a* and 53*a* respectively.

Each of precincts 51, 52, 53, 54 and 55 are comprised of differing basic tile shapes identified as Types A, B, C, D and E tiles which are illustrated in FIGS. 54 to 58 respectively.

Figure 54:
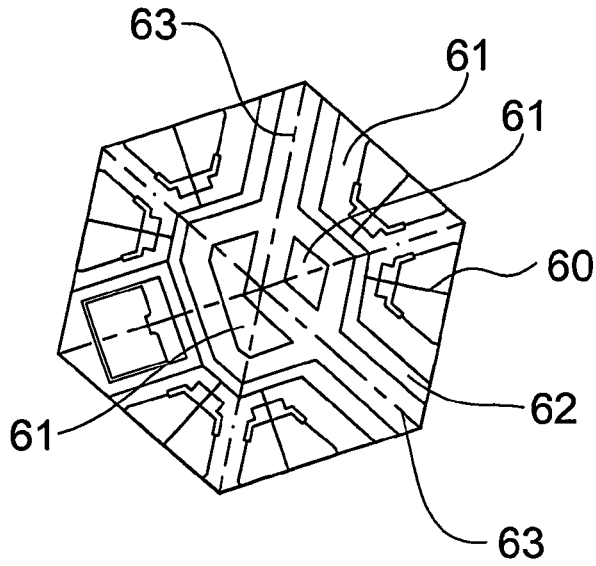
FIG. 54 shows a subdivided plot in a realistic situation.
Figure 55:
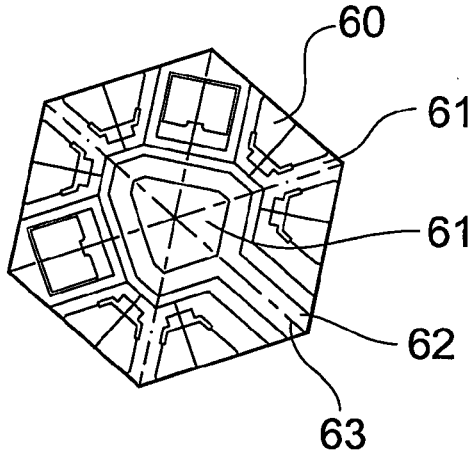
FIGS. 55 to 58 show differing precincts within the subdivision of FIG. 54, the precincts being identified as Type A, B, C, D and E.
Figure 56:
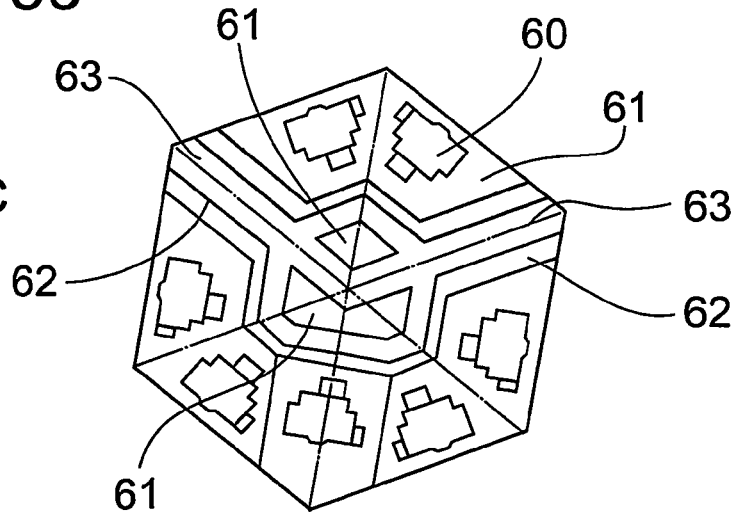
Figure 57:
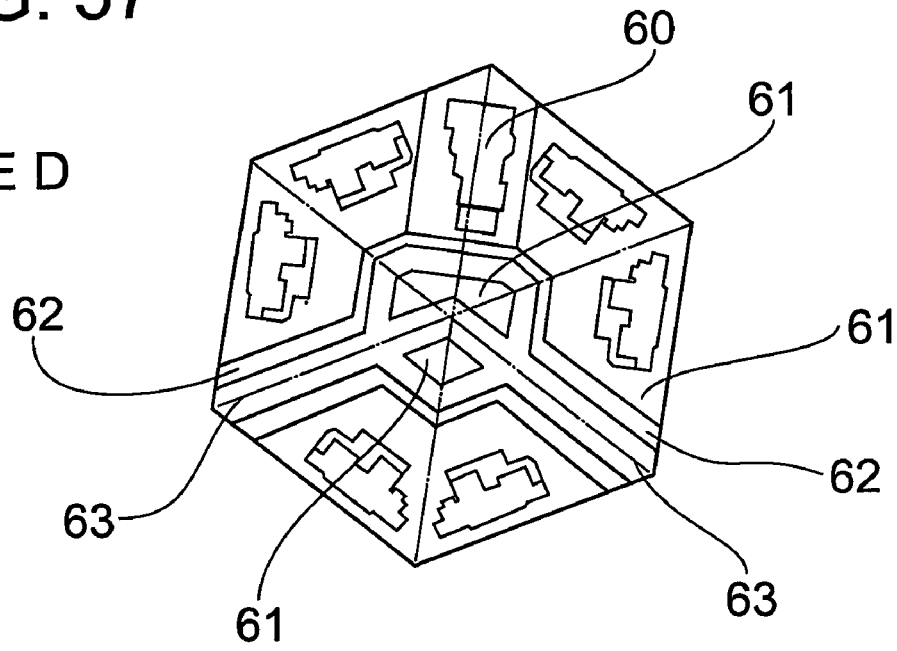
Figure 58:
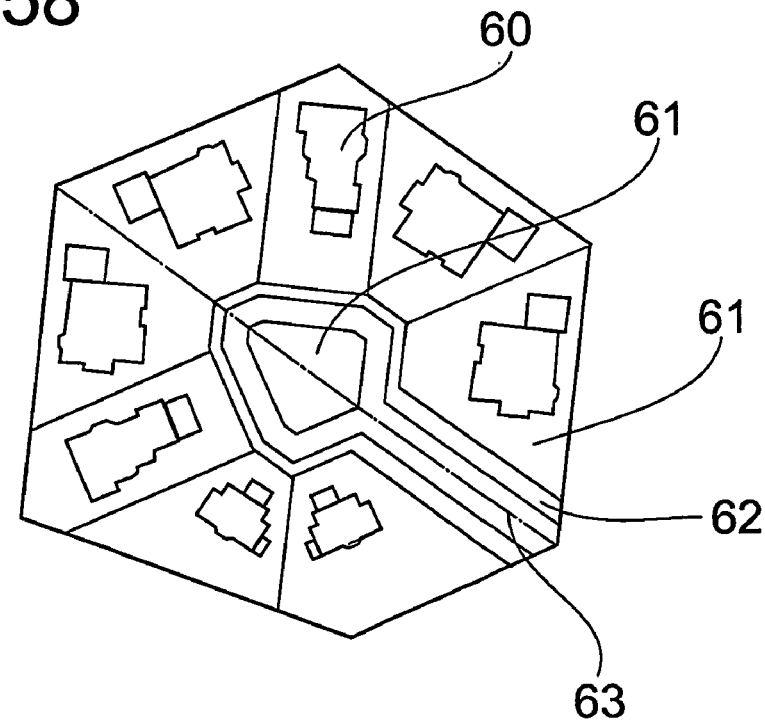

FIGS. 54 and 55 show basic tessellation layouts for quarter-detached houses and semi-detached houses respectively while FIGS. 56 to 58 show differing bungalow configurations. In each of FIGS. 54 to 58 the basic tile configuration comprises building structures 60, unoccupied land area (gardens, yards, etc) 61, footpath/drains 62 and access roadways 63.

It can be seen therefore that while the tesselation process can be automated, the capacity to utilize differing basic tile configurations in the tessellation process avoids highly ordered or repetitious visual appearances in a built subdivision with a sufficient level of distinction between property types at both a micro and macro level within the overall sub-divisional development.

The invention claimed is:

1. A method for sub-division of a plot of land, said method comprising the steps of:

with a processor forming on a polygonal basic tile shape a layout of a basic precinct unit comprising an array of occupiable spaces of predetermined shape, at least one access way communicating with each occupiable space; said occupiable spaces each having respective right of occupancy; and, forming an optimized sub-division of said plot of land by tessellating two or more said polygonal basic tile shapes over an area to be sub-divided whereby respective said at least one access way of each basic precinct unit connects with an access way of an adjacent basic precinct unit to form a network of connecting access ways, each said basic precinct unit, together with an adjacent basic precinct unit forming an inter-tile unit of predetermined shape from two or more adjacent occupiable spaces, said inter-tile unit linking adjacent basic precinct units to form a commercial or resident sub-division.

2. A method as claimed in claim 1 wherein said polygonal basic tile shape comprises a plurality of polygonal sub-tiles of predetermined shape.

3. A method as claimed in claim 2 wherein each said polygonal sub-tile comprises a layout including at least portion of an occupiable space and at least portion of an access way.

4. A method as claimed in claim 3 wherein each said polygonal sub-tile further comprises at least portion of a common space.

5. A method as claimed in claim 4 wherein said common space includes roadways and/or pedestrian access ways.

6. A method as claimed in claim 4 wherein said common space includes communal spaces.

7. A method as claimed in claim 2 wherein said sub-tiles comprises part or all of one or more occupiable spaces.

8. A method as claimed in claim 2 wherein each said sub-tile shape is identical.

9. A method as claimed in claim 2 wherein said sub-tiles each comprise an array of discrete occupiable spaces and at least one access way.

10. A method as claimed in claim 9 wherein said sub-tiles further comprise at least one common space region.

11. A method as claimed in claim 9 wherein said sub-tiles have the same or differing shapes.

12. A method as claimed in claim 2 wherein said basic tile shapes are tessellated to form a super-tile shape containing provision for public amenities.

13. A method as claimed in claim 12 wherein said super-tile is tessellated with basic tile shapes of the same or differing shapes.

14. A method as claimed in claim 1 wherein said adjacent occupiable spaces each include a building structure have at least one common wall structure.

15. A method as claimed in claim 14 wherein said building structures are selected from duplex, triplex, quadriplex, pentaplex, sextuplex or octaplex structures or any combination thereof.

16. A method as claimed in claim 15 wherein said occupiable spaces comprise housing lots.

17. A method as claimed in claim 16 wherein said basic precinct unit comprises a basic neighbourhood unit.

18. A method as claimed in claim 15 wherein said occupiable spaces comprise building floor plan layouts.

19. A method as claimed in claim 1 wherein said access way comprises a roadway.

20. A method as claimed in claim 19 wherein said access way comprises pedestrian access ways.

21. A method as claimed in claim 1 whereby subdivisions so formed include a building structure for an occupiable space selected from a duplex, triplex, quadriplex, pentaplex, sextuplex or octaplex configuration wherein dwelling units are separated from adjacent dwelling units by at least one common wall.

22. A land sub-division whenever effected according to claim 1, wherein said polygonal basic tile shapes are tessellated over a subdivided area whereby respective said at least one access way of each basic precinct unit connects with an access way of an adjacent basic precinct unit to form a network of connecting access ways, each said basic precinct unit, together with an adjacent basic precinct unit forming an inter-tile unit of predetermined shape from two or more adjacent occupiable spaces said inter-tile unit linking adjacent basic precinct units over the subdivided area.

23. A method for sub-division of a plot of land, said method characterized by the steps of:

inputting into a processing device dimensional, boundary and topographical contour data of a plot of land to be sub-divided;

selecting from a data storage means associated with said processing device at least one polygonal basic tile shape;

forming on said polygonal basic tile shape a layout of a basic precinct unit comprising an array of occupiable spaces selected from a stored range of predetermined shapes and at least one access way communicating with each occupiable space;

computing a tessellation of said polygonal basic tile shapes over a computed surface of said plot of land within a predetermined dimensional ratio whereby respective said at least one access way of each basic precinct unit connects with an access way of an adjacent basic precinct unit to form a network of connecting access ways over said computed surface of said plot of land to be sub-divided, each said basic precinct unit, together with an adjacent basic precinct unit, forming an inter-tile unit of predetermined shape from two or more adjacent occupiable spaces, said inter-tile unit linking adjacent basic precinct units; and, outputting to a display device a computed sub-divisional plan for said plot of land.

24. A method as claimed in claim 23 wherein said basic polygonal tile shape is formed from two or more polygonal sub-tile shapes of predetermined configuration.

25. A method as claimed in claim 24 wherein a plurality of basic polygonal tile shapes may be combined to form a polygonal super-tile shape of predetermined configuration.

26. A method as claimed in claim 25 wherein polygonal inter-tile shapes, polygonal sub-tile shapes and/or polygonal super-tile shapes are tessellated alone or in any combination thereof to form a computed sub-divisional plan for said plot of land.

27. A method as claimed in claim 26 wherein tessellated sub-tile, basic tile, super-tile and inter-tile units or any combination thereof are applied to a computed sub-divisional plan of a plot of land in a best fit adaptation to accommodate predetermined land boundary and/or land contour variations.

28. A method as claimed in claim 27 wherein computed artefacts absent from said basic precinct units are incorporated into said computer subdivisional plan of said plot of land without substantial distortion to said network of connecting access ways.

* * * * *